US007866268B2

(12) United States Patent
Nagel et al.

(10) Patent No.: US 7,866,268 B2
(45) Date of Patent: Jan. 11, 2011

(54) HEIGHT ADJUSTABLE LEG ASSEMBLY

(75) Inventors: Duane F. Nagel, Grand Rapids, MI (US); Joylene M. Battey, Middleville, MI (US)

(73) Assignee: Steelcase Inc., Grand Rapids, MI (US)

( * ) Notice: Subject to any disclaimer, the term of this patent is extended or adjusted under 35 U.S.C. 154(b) by 735 days.

(21) Appl. No.: 11/714,454

(22) Filed: Mar. 6, 2007

(65) Prior Publication Data

US 2007/0204771 A1 Sep. 6, 2007

Related U.S. Application Data

(60) Provisional application No. 60/779,642, filed on Mar. 6, 2006.

(51) Int. Cl.
*A47B 9/00* (2006.01)
*A47B 9/20* (2006.01)
*F16M 11/26* (2006.01)

(52) U.S. Cl. ..... 108/144.11; 108/147.21; 248/188.5

(58) Field of Classification Search .... 108/144.11–148; 248/188–188.91
See application file for complete search history.

(56) References Cited

U.S. PATENT DOCUMENTS

| | | | | | |
|---|---|---|---|---|---|
| 2,378,852 | A | * | 6/1945 | James | 403/80 |
| 2,831,739 | A | * | 4/1958 | Fryckholm | 248/188.5 |
| 3,099,891 | A | * | 8/1963 | Handler | 248/188.9 |
| 3,523,702 | A | * | 8/1970 | Unti et al. | 403/107 |
| 3,875,712 | A | * | 4/1975 | Thompson | 52/263 |
| 5,163,373 | A | * | 11/1992 | Anderson et al. | 108/158.12 |
| 6,364,128 | B1 | * | 4/2002 | Wohlford | 211/26 |

* cited by examiner

*Primary Examiner*—Janet M Wilkens
*Assistant Examiner*—Timothy M Ayres
(74) *Attorney, Agent, or Firm*—Quarles & Brady LLP

(57) ABSTRACT

A multi-configurable furniture assembly including height adjustable legs, a height adjustable pedestal support structure, a variable height foot support for cabinets and shelves and a panel wall assembly where each of the separate assemblies have finished and high quality appearances after a configuration is constructed.

26 Claims, 15 Drawing Sheets

30'
65
64
30
4
50
67
31
68
43
70
44
34
36
38
58
46
62
42
40
52
66
4

FIG. 6
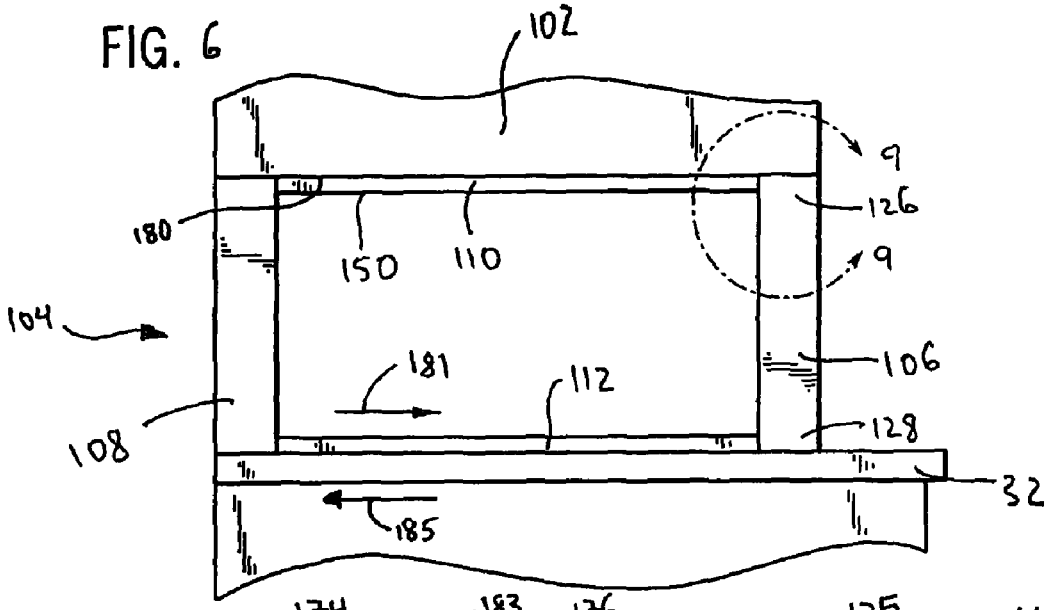
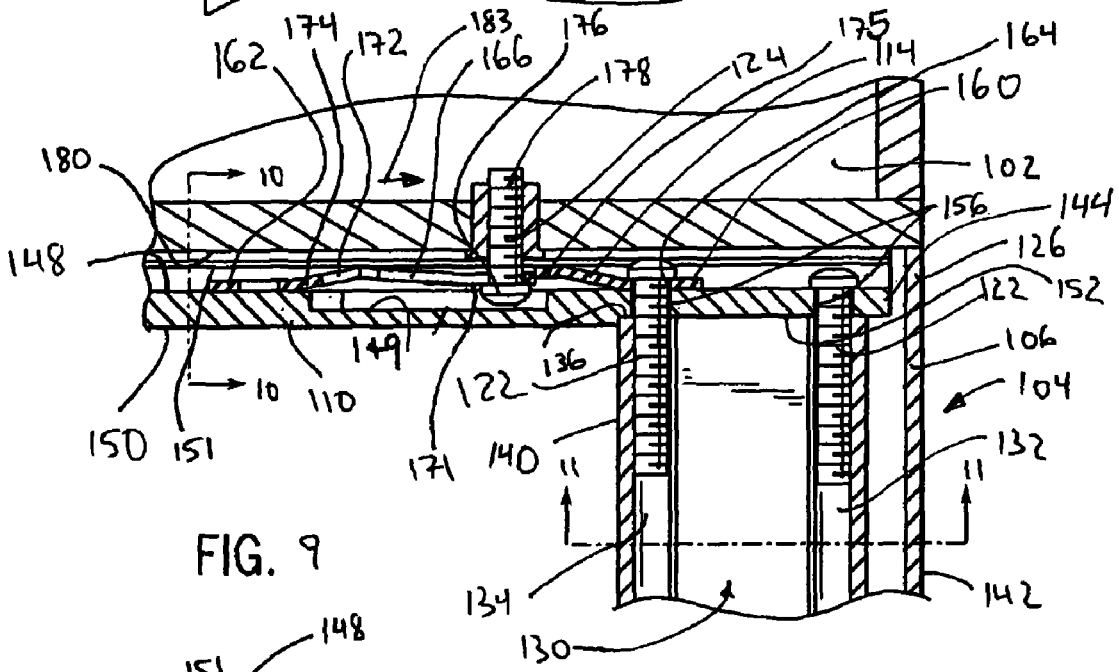
FIG. 9
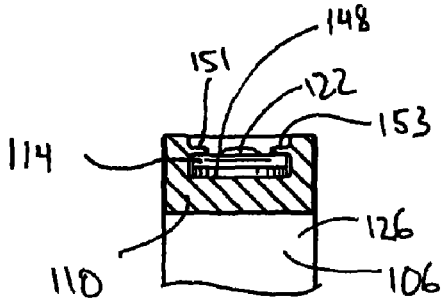
FIG. 10
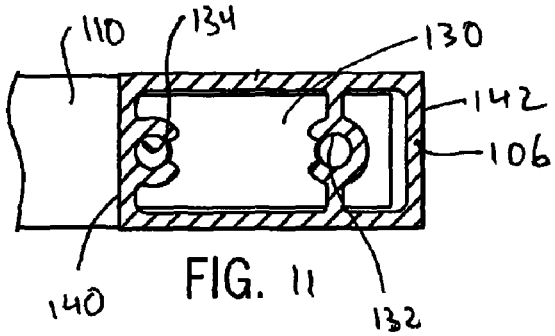
FIG. 11

FIG. 14
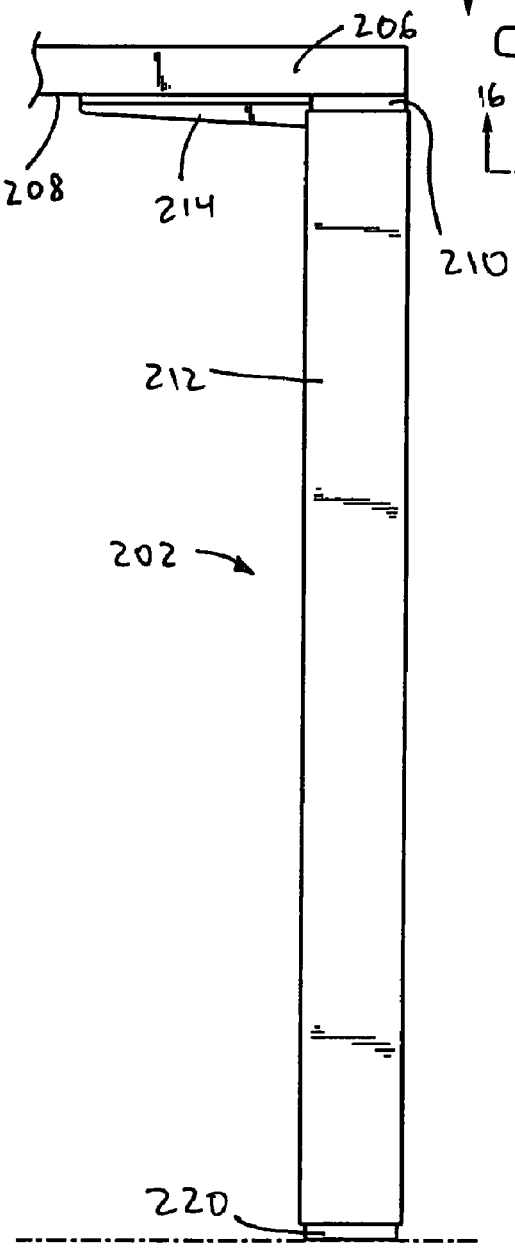
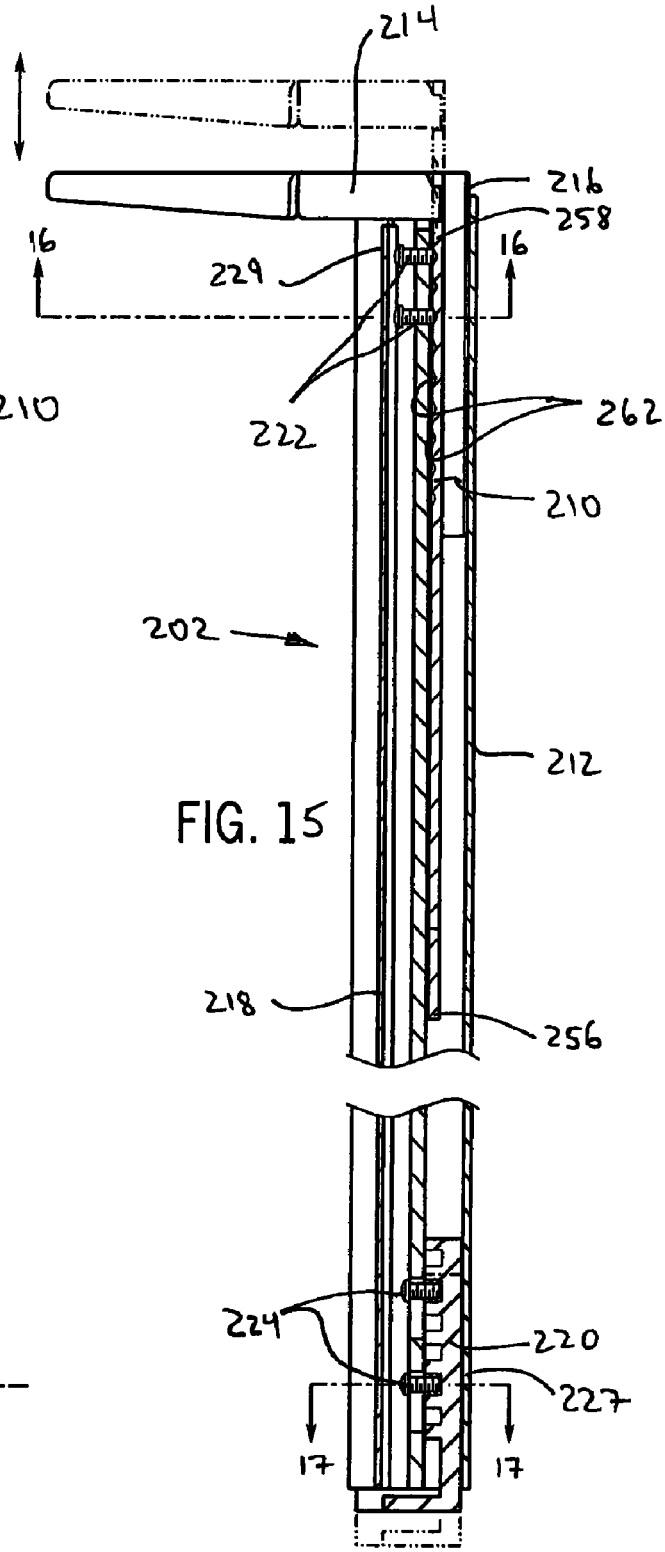
FIG. 15

HEIGHT ADJUSTABLE LEG ASSEMBLY

CROSS-REFERENCE TO RELATED APPLICATIONS

This application claims priority to U.S. provisional application Ser. No. 60/779,642 filed Mar. 6, 2006, entitled "Desk Configuration", and which is hereby incorporated by reference.

STATEMENT REGARDING FEDERALLY SPONSORED RESEARCH OR DEVELOPMENT

Not applicable.

FIELD OF THE INVENTION

The present invention relates to workspace configurations and more specifically to a desk and workspace system that includes several height adjustable components that can be used to assemble many different and useful configurations.

BACKGROUND OF THE INVENTION

People come in all different sizes and differently sized people often are most comfortable working at work surfaces that are at heights that are optimal for their specific size. For instance, while a person that is five feet tall may be most comfortable at a work surface that is 28.5 inches high, a person that is seven feet tall may be most comfortable at a work surface that is 31.5 inches high and likely would be uncomfortable at the 28.5 inch high surface.

In addition to wanting work surfaces at different heights, different people often want other furniture components at different heights as well either to accommodate their physical attributes or simply to create a certain aesthetic look or feel. For instance, by simply altering the space between the undersurface of a cabinet that resides above the top surface of a credenza, the entire look and feel of a furniture configuration can be altered. For example, where the credenza to cabinet space is twelve inches a sleek appearance results whereas a space of twenty-four or more inches can result in a more open and airy appearance.

To accommodate preferences of people of different sizes and different personal preferences regarding work surface height and the heights of other furniture components, the furniture industry has developed many different furniture systems that facilitate customized adjustment of work surface heights, shelf heights, cabinet heights, etc. Unfortunately, typically the components that facilitate work surface, shelf, cabinet, etc., height adjustment are not very elegant. To this end, work surface, shelf, cabinet, etc., height adjusting mechanisms often include unsightly telescoping structures, locking structures, fastening structures, exposed tracks or rails.

Where an application requires a more finished furniture appearance, unsightly systems that include structure to facilitate height adjustability often cannot be employed. For instance, in the case of an executive office, unsightly height adjustable structures simply are not desirable in most cases.

Instead of relying on height adjustable structures in customized height applications that require a more finished appearance, one solution has been to design and build customized furniture that meets specific user preferences. While customization results in optimized furniture, customization is extremely expensive and, in at least some cases, is cost prohibitive. In addition, where custom furniture is designed and built, typically the furniture cannot later be reconfigured to accommodate some other person's preferences.

Because of the costs and inflexibility associated with customization, in many cases where finished appearance is required, height adjustability is foregone and standard height work surfaces, shelves and cabinets are used.

BRIEF SUMMARY OF THE INVENTION

Some inventive embodiments include an adjustable length leg assembly for use with a table top member having an undersurface, the leg assembly comprising a first elongated member having a length dimension between first and second oppositely extending ends, including an external surface, forming an internal channel that extends at least part way along the length dimension at the first end and forming at least a first opening that opens into the channel proximate the first end, a second elongated member having a length dimension between first and second oppositely extending ends, wherein the second end of the second elongated member is receivable within the internal channel and wherein one of the first end of the second elongated member and the second end of the first elongated member is mounted to the undersurface of the top member, at least a first fastener extending through the first opening and into the channel, the first fastener operable to engage the second elongated member in the channel to retain the second elongated member position with respect to the first elongated member and a cover member supported by the external surface of the first elongated member proximate the first opening so as to impede view of the fastener.

Some embodiments include an adjustable length leg assembly for use with a table top member having an undersurface, the leg assembly comprising a first elongated member having a length dimension between first and second oppositely extending ends, forming internal and external channels that extend at least part way along the length dimension at the first end and forming at least a first opening that opens from the external channel into the internal channel proximate the first end, a second elongated member having a length dimension between first and second oppositely extending ends, wherein the second end of the second elongated member is receivable within the internal channel and wherein one of the first end of the second elongated member and the second end of the first elongated member is mounted to the undersurface of the top member and at least a first fastener including internal and external oppositely extending ends, the first fastener positionable with the external end accessible from within the external channel and the internal end located within the internal channel and engaging the second elongated member within the channel to maintain the position of the second elongated member with respect to the first elongated member.

Some embodiments include an adjustable length leg assembly for use with a table top member having an undersurface, the leg assembly comprising a first elongated member having a length dimension between first and second oppositely extending ends, the first elongated member including first and second outer wall member, first and second inner wall members, an intermediate wall member and first and second end wall members that form a substantially V-shaped internal channel, the first and second outer wall members linked along adjacent edges and forming an angle, the intermediate wall member linked along one edge to an adjacent edge of the first inner wall member and linked along an opposite edge to an adjacent edge of the second inner wall member where the first and second inner wall members form an angle, the first end wall linking an edge of the first outer wall member opposite the second outer wall member to an edge of the first inner wall member opposite the intermediate wall member such that the first outer wall member and the first inner wall member are substantially parallel, the second end wall linking an edge of the second outer wall member opposite the first outer wall member to an edge of the second inner wall member opposite the intermediate wall member such that the second outer wall member and the second inner wall member are substantially parallel, the intermediate wall member forming at least a first threaded opening that opens into the internal channel, a second elongated member that includes first and second ends, the second end of the second elongated member including first and second lateral members and an intermediate member, opposite edges of the intermediate member linking the first and second lateral members such that the first and second lateral members form an angle substantially similar to the angle formed by the first and second outer wall members, the second end of the second elongated member receivable within the internal channel and a fastener including a threaded shaft having internal and external ends, the shaft receivable within the opening with the internal end bearing against the intermediate member and the first and second lateral members bearing against the first and second outer wall members, respectively, to maintain the position of the second elongated member with respect to the first elongated member, wherein one of the first end of the second elongated member and the second end of the first elongated member is mounted to the undersurface of the top member.

In addition, some embodiments include a support assembly for supporting a furniture component above a work surface, the furniture component forming a component surface, the assembly comprising a first vertical member that extends between first and second oppositely extending ends and that forms an interior lateral surface, the interior lateral surface of the first vertical member forming first and second end channels at the first and second ends, respectively, that open laterally in the same direction, a second vertical member that extends between first and second oppositely extending ends and that forms an interior lateral surface, the interior lateral surface of the second vertical member forming first and second end channels at the first and second ends, respectively, that open laterally in the same direction, a first horizontal member that extends between first and second oppositely extending ends and that forms a first horizontal channel, the first and second ends of the first horizontal member received and mechanically linked within the first end channels of the first and second vertical members, respectively, the first horizontal member linkable for support to the work surface and a second horizontal member that extends between first and second oppositely extending ends and that forms a second horizontal channel, the first and second ends of the second horizontal member received and mechanically linked within the second end channels of the first and second vertical members, respectively, the second horizontal member linkable to the component surface.

Moreover, some embodiments include a support assembly for supporting a furniture component above a work surface, the furniture component forming a component surface, the assembly comprising a first vertical member that extends between first and second oppositely extending ends and that forms a lateral surface substantially normal to a length dimension of the first vertical member, a second vertical member that extends between first and second oppositely extending ends and that forms a lateral surface substantially normal to a length dimension of the second vertical member, a first horizontal member that extends between first and second oppositely extending ends and that forms a first horizontal channel substantially normal to a length dimension of the first horizontal member, the first horizontal member releasably linkable for support to the work surface and a second horizontal member that extends between first and second oppositely extending ends and that forms a second horizontal channel substantially normal to a length dimension of the second horizontal member, the second horizontal member releasably linkable to the component surface and wherein the first and second ends of the first horizontal member are releasably fastened to the first ends of the first and second vertical members, respectively, and the first and second ends of the second horizontal member are releasably fastened to the second ends of the vertical members, respectively, and the first and second horizontal channels face in opposite directions.

Furthermore, some embodiments include a method for use with a work surface and a furniture component having a component surface, the method for releasably supporting the furniture component above the work surface, the method comprising the steps of proving a support assembly including first and second oppositely facing substantially horizontal channels, providing at least first and second fastener assemblies that each include a first jamb type coupler and a second coupler that cooperates with the jamb type coupler, mounting one of the first and second couplers of the first fastener assembly to the work surface, mounting the other of the first and second couplers of the first fastener assembly substantially within the first horizontal channel, mounting one of the first and second couplers of the second fastener assembly to the component surface, mounting the other of the first and second couplers of the second fastener assembly substantially within the second horizontal channel, aligning the first coupler of the first fastener assembly with the second coupler of the first fastener assembly, moving the support assembly along a trajectory relative to the work surface to cause the second coupler of the first fastener assembly to move into a jamming position with respect to the first coupler of the first fastener assembly, aligning the first coupler of the second fastener assembly with the second coupler of the second fastener assembly and moving the furniture component relative to the support assembly along a trajectory to cause the second coupler of the second fastener assembly to move into a jamming position with respect to the first coupler of the second fastener assembly.

Some embodiments include a support kit for supporting a furniture component at different heights above a work surface, the furniture component forming a component surface, the kit comprising a first pair of vertical members, each vertical member in the first pair extending between first and second oppositely extending ends and having a first length dimension, a second pair of vertical members, each vertical member in the second pair extending between first and second oppositely extending ends and having a second length dimension that is greater than the first length dimension, a first horizontal member that extends between first and second oppositely extending ends and that forms a first horizontal channel that opens substantially normal to a length dimension of the first horizontal member, the first horizontal member releasably linkable for support to the work surface and a second horizontal member that extends between first and second oppositely extending ends and that forms a second horizontal channel that opens substantially normal to a length dimension of the second horizontal member, the second horizontal member releasably linkable to the component surface, wherein the vertical members of each of the first and second pair are independently releasably fastenable at the member ends between the ends of the first and second horizontal members to change the height of the furniture component with respect to the work surface.

Other embodiments include a panel assembly for use with a support configuration, the panel assembly comprising a substantially rigid backer member having top and bottom edges and oppositely facing front and rear surfaces, at least one filler member having a peripheral edge and oppositely facing front and rear surfaces, the rear surface of the filler member mounted to and covering a portion of the front surface of the backer member at least in part by at least one perpendicular trajectory coupling component and a slat wall segment having a peripheral edge and oppositely facing front and rear surfaces, the rear surface of the slat wall segment mounted to and covering a portion of the front surface of the backer member with at least a portion of the peripheral edge of the slat wall segment butting up against at least a portion of the peripheral edge of the filler member where the front surface of the slat wall segment is substantially flush with the front surface of the filler member.

Still other embodiments include a panel assembly for use with a support configuration, the panel assembly comprising a substantially rigid backer member having oppositely facing front and rear surfaces, the backer member forming a channel in the front surface and supported by the support configuration and a slat wall segment having oppositely facing front and rear surfaces, the slat wall segment mounted in the channel with the front surface of the slat wall segment substantially flush with the front surface of the backer member.

These and other objects, advantages and aspects of the invention will become apparent from the following description. In the description, reference is made to the accompanying drawings, which form a part hereof, and in which there is shown a preferred embodiment of the invention. Such embodiment does not necessarily represent the full scope of the invention and reference is made to the claims herein for interpreting the scope of the invention.

BRIEF DESCRIPTION OF THE SEVERAL VIEWS OF THE DRAWINGS

FIG. 6 is a side plan view taken along the line 6-6 in FIG. 1 showing a foot assembly according to at least some inventive embodiments;

FIG. 9 is a cross-sectional view taken along the line 9-9 of FIG. 6 showing various mounting components that form a portion of the foot support assembly of FIG. 6;

FIG. 10 is a cross-sectional view taken along the line 10-10 in FIG. 9 showing a channel formed by an upper horizontal member;

FIG. 11 is a cross-sectional view taken along the line 11-11 in FIG. 9 showing the cross-section of a vertical upright member;

FIG. 14 is a side plan view of one of the leg assemblies of FIG. 1 taken along line 14-14 in FIG. 1;

FIG. 15 is a partial cross-sectional view of the leg assembly of FIG. 12;

DETAILED DESCRIPTION OF THE INVENTION

Figure 1:
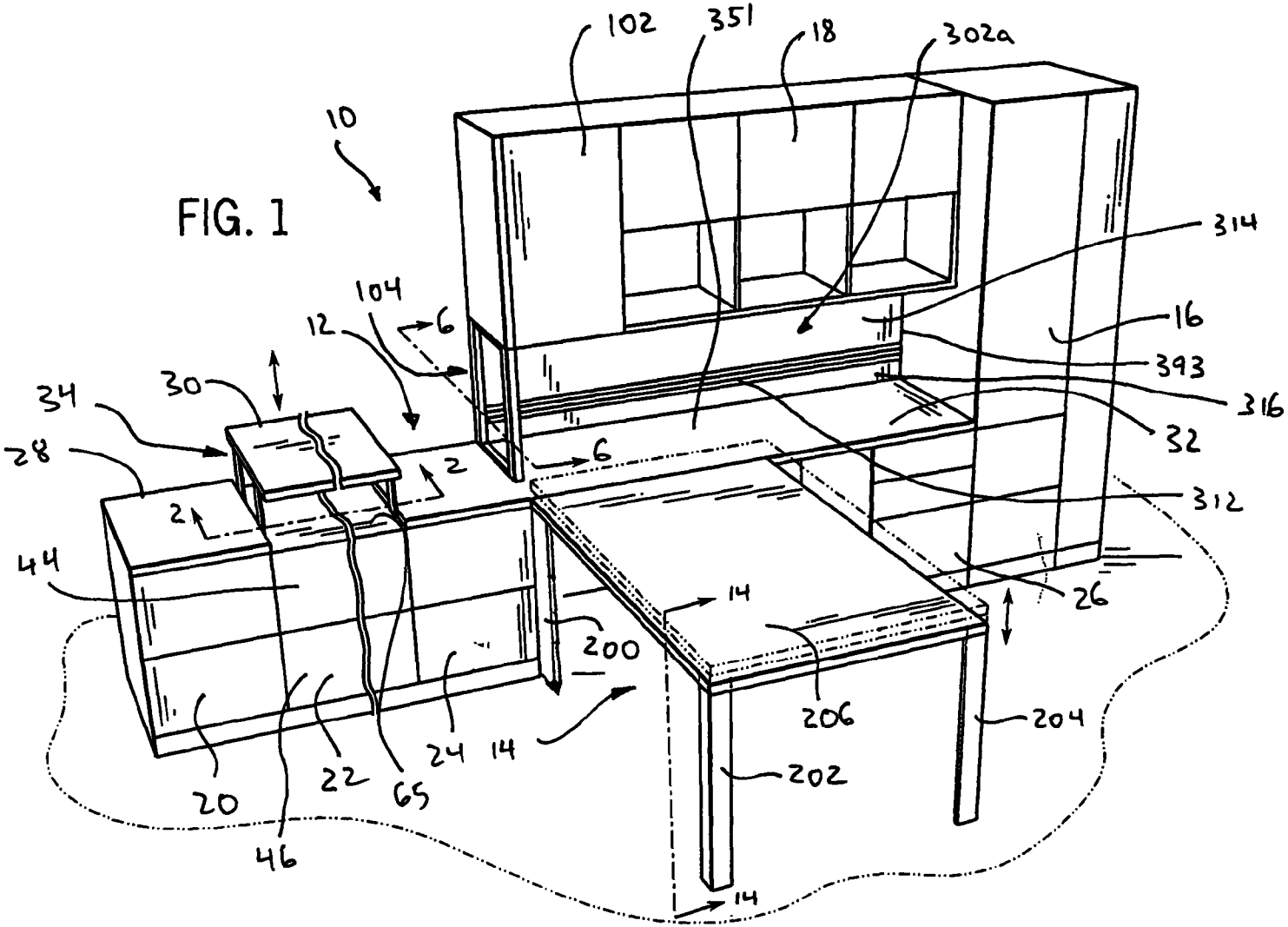
FIG. 1 is a perspective view of an exemplary furniture system, including several different assemblies that are consistent with various aspects of the present invention.

Referring now to the drawings wherein like reference numerals correspond to similar elements throughout the several views and, more specifically, referring to FIG. 1, the present invention and various aspects of the invention will be described in the context of an exemplary furniture system 10 including, among other components, a credenza or pedestal assembly 12, a table assembly 14, a closet unit 16, a shelf/cabinet assembly 18 and a panel or wall assembly 302*a*. Credenza or pedestal assembly 12 includes a lower structure that forms first, second, third and fourth drawer sleeves, 20, 22, 24 and 26, respectively, first, second and third horizontal top members 28, 30 and 32, respectively, that form upper work surfaces and pedestal support assemblies collectively identified by numeral 34 in FIG. 1 for adjusting the height of second top member 30 as will be explained in greater detail below.

Referring still to FIG. 1 and also to FIGS. 2 through 5, the credenza or pedestal understructure that forms the second drawer sleeve 22 includes, among other components, first and second lateral upright credenza support members 36 and 38, a back credenza member 35, a top spacer member 64 and a bottom spacer member 66. Lateral support members 36 and 38 are rigid planar members that are generally oriented vertically and are spaced apart by the top spacer member 64 and bottom spacer member 66 to form a drawer sleeve space 43 there between. Back credenza member 35 encloses the rear side of space 43 (see specifically FIG. 4).

Figure 2:
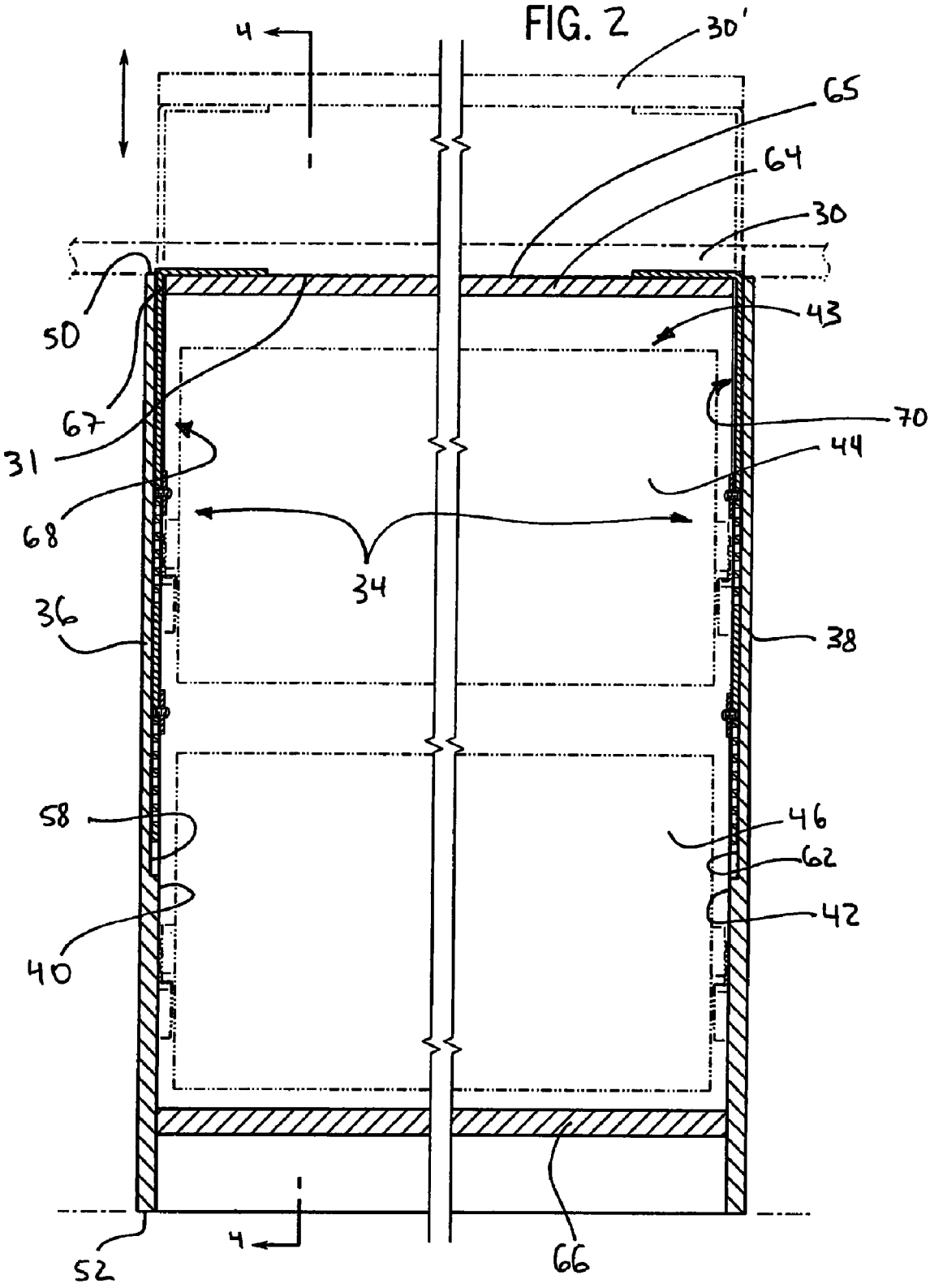
FIG. 2 is a cross-sectional view taken along the line 2-2 in FIG. 1 showing components that form part of an exemplary height adjustable pedestal assembly.

As best seen in FIG. 2, when members 36, 38, 64 and 66 are secured together to form space 43, vertical surfaces 40 and 42 of members 36 and 38 are parallel and face each other. Hereinafter, unless indicated otherwise, surfaces 40 and 42 will be referred to as internal surfaces.

Each of lateral members 36 and 38 have similar features and perform similar functions and therefore, in the interest of simplifying this explanation, only lateral member 36 will be described here in detail. Referring still to FIGS. 2 through 5, lateral member 36 is a rectilinear planar rigid member having oppositely facing top and bottom edges 50 and 52, respectively, and opposite facing front and rear edges 54 and 56, respectively. Internal surface 40 forms vertically aligned front and rear channels 58 and 60, respectively, proximate front and rear edges 54 and 56, respectively, where each of the channels 58 and 60 open at top edge 50 but terminate short of bottom edge 52. Each of channels 58 and 60 has similar dimensions. As best seen in FIG. 4, channel 60 has a width dimension W1 that is uniform along its length. Along lateral edges of each of channels 58 and 60 mounting holes are formed in internal surface 40. More specifically, at three different locations along the length of channel 60, mounting hole pairs are formed including first and second mounting hole pairs 61*a* and 61*b* near a top end of channel 60, with a separate one of the pairs 61*a* and 61*b* formed on each side of channel 60, hole pairs 61*e* and 61*f* formed on opposite sides of channel 60 near bottom end of channel 60 and channel pairs 61*c* and 61*d* formed on opposite sides of channel 60 at an intermediate location between the top and bottom ends of channel 60. Although not labeled, a similar pattern of mounting hole pairs are formed along the opposite sides of channel 58.

Referring yet again to FIGS. 2 through 5, the pedestal support assemblies 34 include first and second pedestal support assemblies 68 and 70, a separate one of the support assemblies 68 and 70 respectively associated with each of the upright lateral support members 36 and 38. Each of the support assemblies 68 and 70 has a similar construction and operates in a similar fashion and therefore, in the interest of simplifying this explanation, only first pedestal support assembly 68 will be described here in detail. Assembly 68 includes first and second telescoping assemblies 72 and 74. Each of the telescoping assemblies 72 and 74 is similarly constructed and operates in a similar fashion and therefore, in the interest of simplifying this explanation, only the second telescoping assembly 74 will be described here in detail.

Referring to FIGS. 2 through 5, second telescoping assembly 74 includes a telescoping member 76, a finished cover 78, a first bracket member 80, a second bracket member 82, mounting screws 84 and first and second adjustment screws or fasteners 86 and 88, respectively. Telescoping member 76 is a rigid integral member that includes an elongated flat arm member 90 and a relatively shorter flat shoulder member 92. Arm member 90 extends from a bottom end 93 to a top end 91, has a width W2 (see specifically FIG. 4) that is slightly less than width W1 of channel 60 and forms first and second pluralities of adjustment holes where a subset of the first plurality of adjustment holes is identified by label 94*a* and a subset of the second plurality of adjustment holes is identified by label 94*b* in the figures. The first plurality of adjustment holes or openings are arranged to form a single line along a midsection of arm member 90 midway between the lateral edges of member 90 that define width W2. Similarly, the second plurality of adjustment holes 94*b* form a line proximate bottom end 93 that is midway between the lateral edges that define width W2. In some embodiments, holes 94*a* and 94*b* will be threaded while in other embodiments, holes 94*a* and 94*b* are not threaded.

Figure 3:
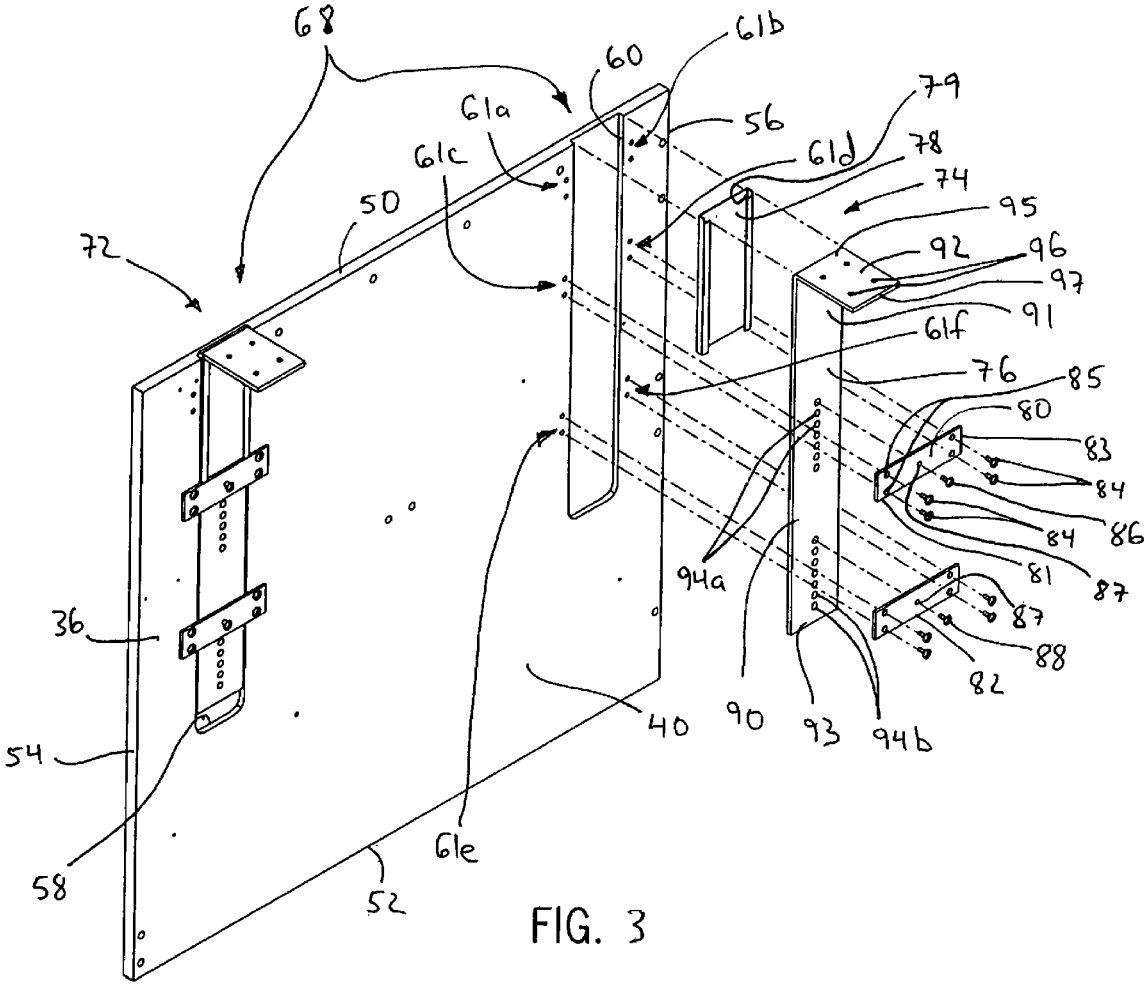
FIG. 3 is a partially exploded perspective view of some of the components shown in FIG. 2.
Figure 4:
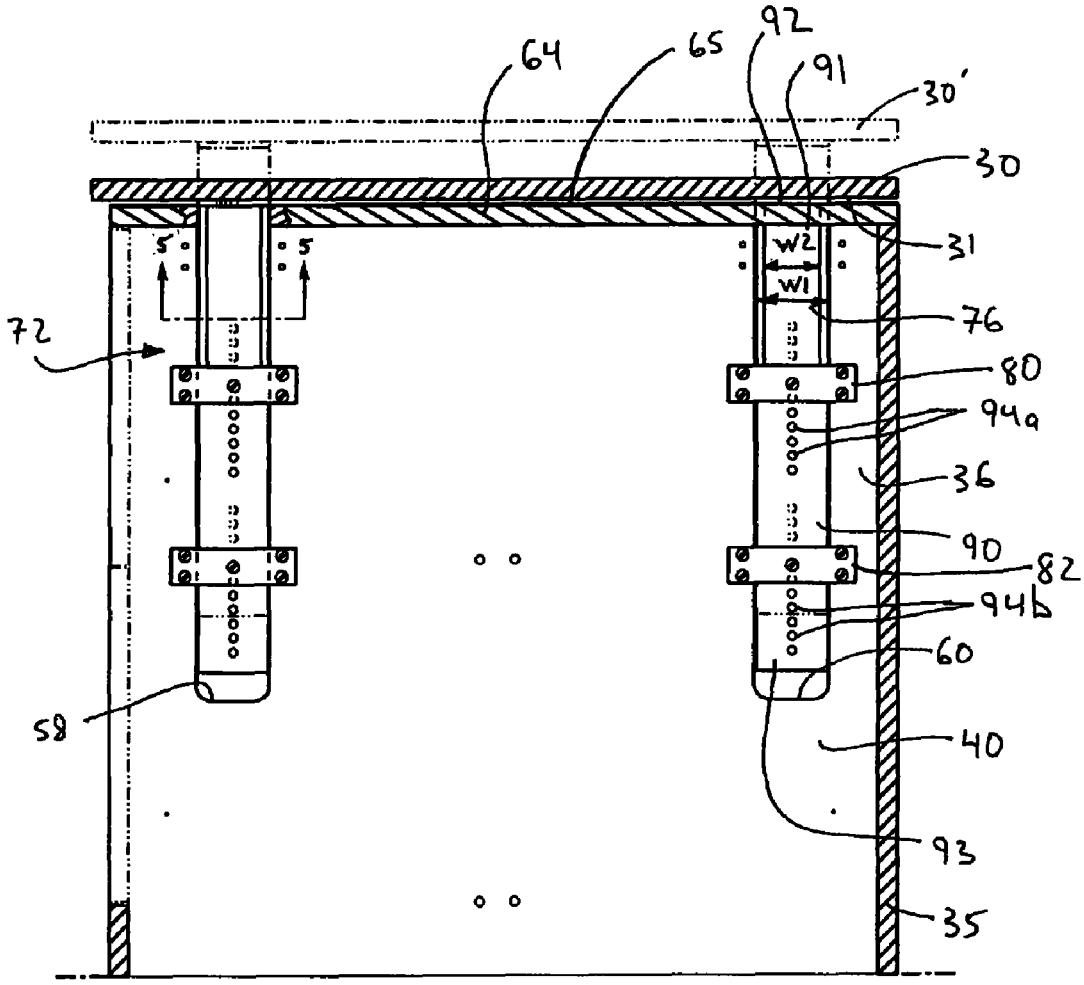
FIG. 4 is a partial cross-sectional view taken along the line 4-4 in FIG. 2.
Figure 5:
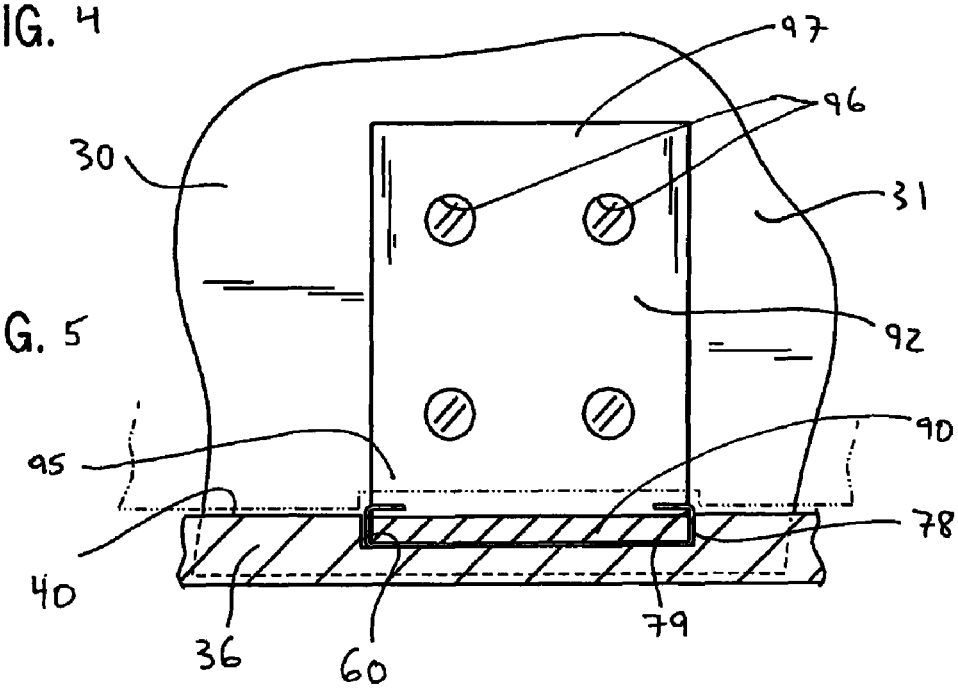
FIG. 5 is a partial cross-sectional view taken along the line 5-5 in FIG. 4.

Shoulder member 92 is a rectilinear rigid member that has a proximal end 95 and a distal end 97 and forms four mounting holes, two of which are collectively identified by numeral 96 in FIGS. 3 and 5. The proximal end 95 of member 92 is integrally connected to or formed with the top end 91 of member 90 so that, in profile, members 90 and 92 form a 90-degree angle and have a L-shaped appearance.

Referring still to FIGS. 3 and 5, finished cover 78 is a rigid elongated member that forms a channel 79 dimensioned to receive arm member 90. In at least some embodiments, to attach cover 78 to arm member 90, the bottom end 93 of member 90 is aligned with channel 79 and slid into channel 79 until cover 78 resides near the top end 91 of member 90. An external surface of cover 78 has a finished appearance so that when the external surface of cover 78 is visible, an elegant appearance results.

Referring still to FIGS. 3 and 4, each of bracket members 80 and 82 has a similar construction and operates in a similar fashion and therefore, in the interest of simplifying this explanation, only bracket member 80 will be described here in detail. Bracket member 80 is a rigid rectilinear member that extends from a first end 81 to a second end 83. Bracket member 80 forms two pairs of mounting holes, one pair identified by numeral 85. The first pair of mounting holes is formed proximate first end 81 and the second pair of mounting holes is formed proximate second end 83. The mounting holes of each pair are spaced apart a dimension that is substantially identical to the dimension of the space between the holes that form each pair of mounting holes that resides along one of the edges of channel 60. For example, in FIG. 3, where one inch separates the holes that form pair 61*c*, one inch would also separate the holes that form pair 85. The two hole pairs formed by member 80 are formed such that they can simultaneously align with hole pairs on opposite sides of channel 60 formed by member 36. In addition to forming the hole pairs 85, member 80 also forms a central adjustment hole 87 midway between the hole pairs 85. In some embodiments hole 87 is threaded while in other embodiments hole 87 is not threaded. Here, it should be apparent that, referring still to FIG. 3, at least one of hole 87 is threaded in each bracket member 80 and 82 or holes 94*a* and 94*b* in member 90 are threaded.

To secure telescoping member 76 to the internal surface 40 of member 36, bracket members 80 and 82 are mounted to surface 40 via mounting screws 84 that pass through the hole pairs 85 formed by bracket members 80 and 82 and into hole pairs 61*c*, 61*d* and hole pairs 61*e*, 61*f*, respectively. Next, with finishing cover 78 mounted to member 90 proximate top end 91, bottom end 93 of member 90 is slid into channel 60 until one of the adjustment holes 94*a* and one of the adjustment holes 94*b* are aligned with the adjustment holes 87 centrally formed in bracket members 80 and 82. Next, adjustment screws 86 and 88 are installed in the aligned holes 87, 94*a*, 94*b* to secure telescoping member 76 within channel 60. Here, it should be appreciated that, by removing screws 86 and 88, telescoping member 76 can be released and its position within channel 60 can be altered to change the height of shoulder member 92.

Referring yet again to FIGS. 1 through 5, shoulder member 92 is mounted to an undersurface 31 of second top member 30 via screws (not labeled or illustrated) such that when the height of shoulder member 92 is changed, the height of top member 30 is likewise altered. By adjusting all of the telescoping assemblies that support a top member 30, the height of top member 30 can be modified. In FIGS. 2 and 4, the top member is shown in phantom 30' in a raised position.

Aesthetically, when the telescoping assemblies (e.g., 72, 74) are in a raised position, the finished external surface of cover 78 is visible and the overall product continues to have a finished appearance despite the height modification. In at least some embodiments, a top surface of spacer member 64 may also be finished to further enhance appearance when member 30 is raised. Referring specifically to FIGS. 1 and 2, when drawers 44 and 46 are installed, pedestal height adjustment mechanisms (e.g., the telescoping assembly 72, 74 etc.) are hidden.

Referring to FIG. 3, by loosening the screws 86 and 88 so that they are outside channel 60, sliding member 76 within channel 60 to a different location and tightening the screws, one in a plurality of different surface heights can be selected. Further height adjustment can be achieved by removing bracket member 82 from its low position aligned with holes 61*e* and 61*f* and reinstalling bracket member 82 with the top hole pairs 61*a* and 61*b*. Here, one screw 88 is inserted through the central hole 87 of bracket member 80 and received in one of the upper holes 94*a* while the second screw 86 is inserted through the central hole 87 of bracket member 82 and received in one of lower holes 94*b* to secure member 76 at the appropriate height.

Referring once again to FIG. 1, the shelf/cabinet assembly 18 includes a shelf/cabinet unit 102 having an undersurface 180, which is supported at one end by closet unit 16 and is supported at the opposite end by a foot support assembly 104. Referring also to FIGS. 6 through 11, foot support assembly 104 includes first and second vertical members 106 and 108 respectively, first and second horizontal members 110 and 112, respectively, first, second, third and fourth bracket members or couplers 114, 116, 118 and 120, respectively, a plurality of mounting screws collectively identified by numerals 122 and four anchor screws, only one illustrated and labeled 124. Each of vertical members 106 and 108 has a similar configuration and operates in a similar fashion and therefore, in the interest of simplifying this explanation, only first vertical member 106 will be described here in detail. Similarly, each of the horizontal members 110 and 112 have similar construction and operates in a similar fashion and therefore, in the interest of simplifying this explanation, only top horizontal member 110 will be described here in detail.

Referring to FIGS. 6 through 11, first vertical member 106 is an elongated rigid, and, in at least some embodiments, extruded, member that extends from a top end 126 to a bottom end 128. As best illustrated in FIG. 11, member 106 has four flat wall members that form a rectangle in cross section and that form an internal channel 130. Internal channel 130, additional portions of member 106 form first and second screw receiving channels 132 and 134, respectively. The external surface of member 106 forms among other surfaces, an interior lateral surface 140 and oppositely facing exterior lateral surface 142.

Figures 7, 8:
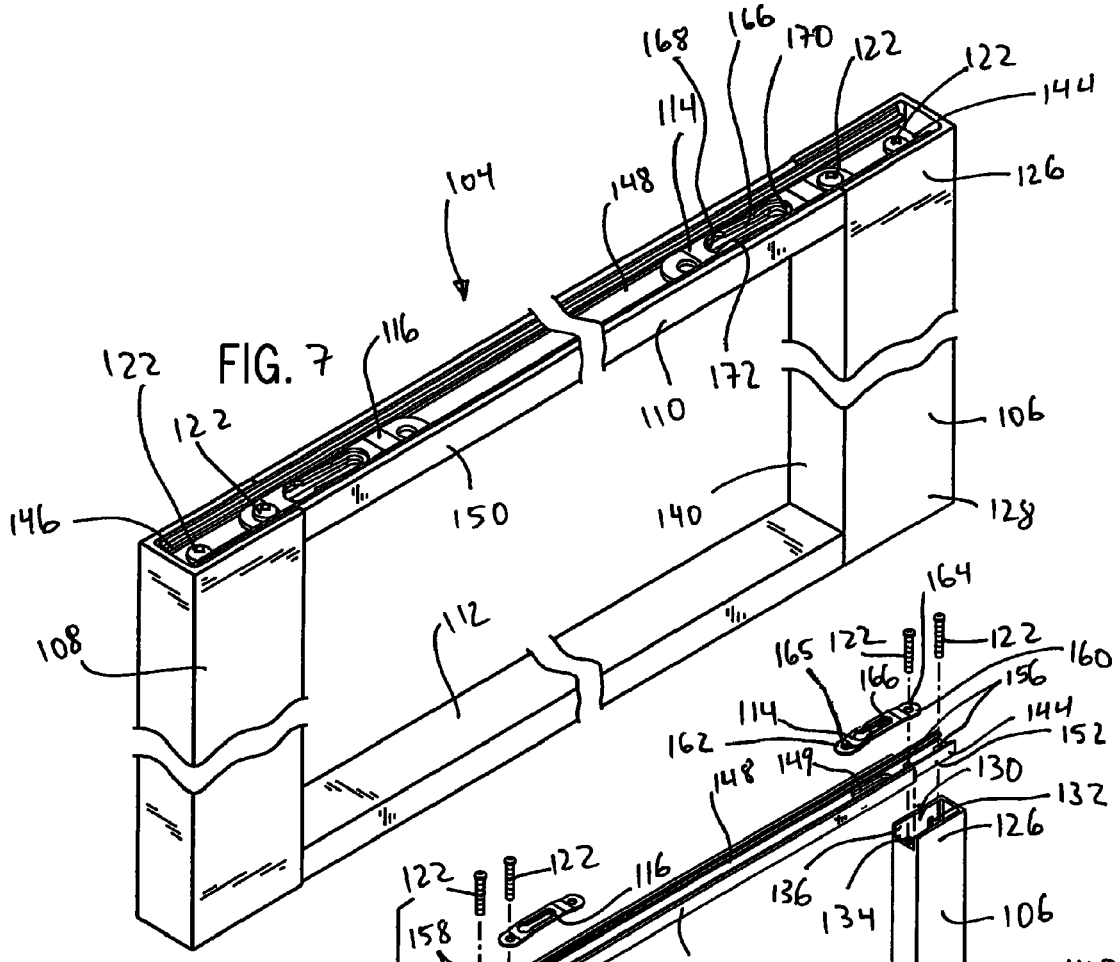
FIG. 7 is a perspective view of the exemplary foot support assembly of FIG. 6.
FIG. 8 is an exploded view of the foot support assembly of FIG. 7.

Referring now to FIGS. 8 and 9, at top end 126, a small portion of extruded member 106 that forms interior lateral surface 140 is removed to form an top end channel 136 that opens at the top end 126. Similarly, at bottom end 128, a portion of the wall that forms interior lateral surface 140 is removed to form a bottom end channel 138. In addition to removing portions of the wall that forms interior lateral surface 140, similarly sized portions of the interior structure that forms channels 132 and 134 are removed at both the top and bottom ends 126 and 128, respectively of member 106.

Referring once again to FIGS. 6 through 11, top horizontal member 110 is an elongated rigid member that extends from a first end 144 to a second end 146 and that forms an elongated horizontal channel 148 that is open along an entire side and that is open at opposite ends. A surface opposite the surface that forms channel 148 is a finished external surface 150 that is exposed after foot support assembly 104 is assembled and mounted for use. At first end 144, horizontal member 110 forms a reduced dimension portion 152. Here, the reduced dimension portion 152 has dimensions such that the portion 152 is receivable within the top end channel 136 formed by member 106 while the middle portion of member 110 has dimensions such that it cannot fit within channel 136. Similarly, at second end 146, a second reduced dimension portion 154 is formed that has dimensions similar to those of the first reduced dimension portion 152 and that is receivable within a top channel (not labeled) formed by second vertical member 108. A first pair of mounting holes 156 is formed in first reduced dimension portion 152 and are spaced apart a dimension similar to the dimension between screw receiving channels 132 and 134 (see FIG. 11). Thus, when first reduced dimension portion 152 is received within top end channel 136, the holes that comprise hole pair 156 align with screw receiving channels 132 and 134. A second pair of holes 158 is formed in second reduced dimension portion 154 and includes holes that are spaced apart by a dimension similar to the dimension that separates the holes that comprise pair 156. Referring specifically to FIGS. 9 and 10, an internal surface that forms channel 148 forms ribs 151 and 153 that extend toward each other along the entire length of channel 148.

Referring to FIGS. 7 through 10, each of the first, second, third and fourth bracket members or couplers 114, 116, 118 and 120 have similar designs and operate in a similar fashion and therefore, in the interests of simplifying this explanation, only first bracket member 114 will be described here in detail. Bracket member 114 is an elongated clip-type member that extends from a first end 160 to a second end 162. At ends 160 and 162, first bracket member 114 includes flat coplanar bracket segments. Between the two flat coplanar segments at ends 162 and 160, bracket member 114 includes first and second ramped segments 174 and 175, respectively. First ramp segment 174 extends upward as illustrated from the end segment at end 162 while second ramp segment 175 extends downward as illustrated from center ramp segment to the other end segment at end 160. In at least some embodiments, ramp segment 174 is more parallel to the plane in which the end segments at ends 160 and 162 reside than is ramp segment 175. An undersurface 171 of bracket member 114 forms a cam surface 171.

Referring still to FIG. 9, each of the bracket members or couplers (e.g., bracket member 114) forms part of a coupler or fastener assembly that also includes another coupler in the form of a screw 124 where the coupler pairs releasably couple. Thus, for the assembly shown in FIG. 8, the assembly would include first, second, third and fourth fastener assemblies associated with bracket members 114, 116, 118 and 120, respectively.

Referring still to FIGS. 7 through 9, bracket member 114 forms an elongated slot 166 having a first end 170 and a second end 168 proximate the first and second ends 160 and 162, respectively, of bracket member 114. Along most of the length of slot 166, the slot has a uniform width. However, at second end 168, slot 166 opens into an enlarged opening 172. In the end segment adjacent first end 160, bracket member 114 forms a first mounting hole 164. Similarly, in the segment proximate second end 162, bracket member 114 forms a second mounting hole 165. In at least some embodiments the brackets used here may be brackets sold under the trademark "Mod-eez" which are sold by Modular Systems, Inc. of Fruitport, Mich.

To assemble foot support assembly 104, first bracket member 114 is slid into channel 148 below ribs 151 and 153 (see FIG. 10) with second end 162 extending in the same direction as second end 146 of member 110. Bracket member 114 is slid along the channel until mounting hole 164 is aligned with the inward hole of first mounting pair 156 (see FIG. 9). Next, second bracket member 116 is slid into channel 148 below ribs 151 and 153 with the second end (not labeled) of bracket member 116 extending in the same direction as second end 146 of member 110. Bracket member 116 is slid within channel 148 until the mounting hole (not labeled) at the second end of bracket member 116 is aligned with the inward hole of pair 158. Next, first reduced dimension portion 152 is positioned within top channel 135 at end 126 of member 106 so that hole pair 156 is aligned with channels 132 and 134. As best illustrated in FIG. 9, one mounting screw 122 is inserted through hole 164 and the inward hole of pair 156 and is threadably received within channel 134. A second mounting screw 122 is inserted through the outward hole of pair 156 and is threadably received within channel 132. Once the two mounting screws 122 are tightened within channels 132 and 134, member 110 is securely mounted to member 106.

Two additional mounting screws 122 are used to mount bracket member 116 and the second reduced dimension portion 154 to the top end of vertical member 108 in a fashion similar to that described above. Similarly, screws 122 are used to mount bracket members 118 and 120 and reduced dimension portions of horizontal member 112 to bottom ends of members 106 and 108 so as to form the foot support assembly 104 illustrated in FIG. 7.

Referring now to FIG. 9, anchor screws 124 (only one shown) are secured to each of a top surface to which assembly 104 is to be mounted and to the undersurface 180 of a structure to be mounted above assembly 104. In the example illustrated in the figures and, more specifically, in FIG. 1, two anchor screws akin to anchor screw 124 in FIG. 9 are installed in a top surface of member 32 and two other anchor screws are installed in an undersurface of shelf/cabinet unit 102 (e.g., see undersurface 180 in FIG. 9). When the anchor screws 124 are installed, the screws are installed so that spacing between each pair of screws is equal to the spacing between enlarged openings 172 of the first and second bracket members 114 and 116 and so that a portion of the anchor screw shaft 178 extends from the undersurface 180 so that an anchor screw head 176 is separated from surface 180.

Referring to FIGS. 1 and 6 through 10, to mount foot support assembly 104 to a top surface of member 32, assembly 104 is positioned such that enlarged openings (e.g., 172) of bracket members 118 and 120 are aligned with the heads (e.g., see 176 in FIG. 9) of the anchor screws 124 that are secured to the top surface of member 32. Next, assembly 104 is moved downward until the anchor screw heads 176 are received through enlarged openings 172 and assembly 104 is forced forward along a first trajectory as indicated by arrow 181 such that the anchor screw heads 176 ride on the cam surface 171 thereby forcing member 112 against the top surface of member 32. This camming activity causes assembly 104 to jam onto the screw heads 176. To remove assembly 104 after installation on the top surface of member 32, assembly 104 can simply be forced along a second trajectory in the direction indicated by arrow 185 a distance such that heads 176 (see again FIG. 9) move to the second ends 168 of the bracket slots 166 and, when the heads 176 are aligned with enlarged openings 172, assembly 104 can be lifted from member 32.

Referring still to FIGS. 1 and 6 through 10, to mount shelf/cabinet unit 102 to the top of foot support assembly 104, anchor screw heads 176 (see again FIG. 9) are aligned with the enlarged openings 172 in slots 166 of bracket members 114 and 116. Once heads 176 are received in the enlarged openings 172, shelf/cabinet unit 102 is moved in the direction indicated by arrow 183 in FIG. 9 until the heads 176 are received in the first ends 170 of the slots 166 where jamming activity again secures assembly 104 to unit 102.

In at least some embodiments it is envisioned that vertical upright members 106, 108 will come in various standard lengths and that a foot assembly kit will be available that includes multiple standard length members so that a person installing a foot assembly can select which length members to use so that different designs can be configured. For instance, the members 106 and 108 in FIG. 1 are clearly longer than the members 106 and 108 in FIG. 6. In at least some cases it is contemplated that a kit will include three or more pairs of different length vertical members so that three different foot assembly heights can be configured.

Referring again to FIG. 1, table assembly 14 includes the top member 206 and four separate leg assemblies, three of which are illustrated and are identified by numerals 200, 202 and 204. Each of the leg assemblies 200, 202 and 204 have similar constructions and operate in a similar fashion and therefore, in the interest of simplifying this explanation, only leg assembly 202 will be described here in detail.

Figure 16:
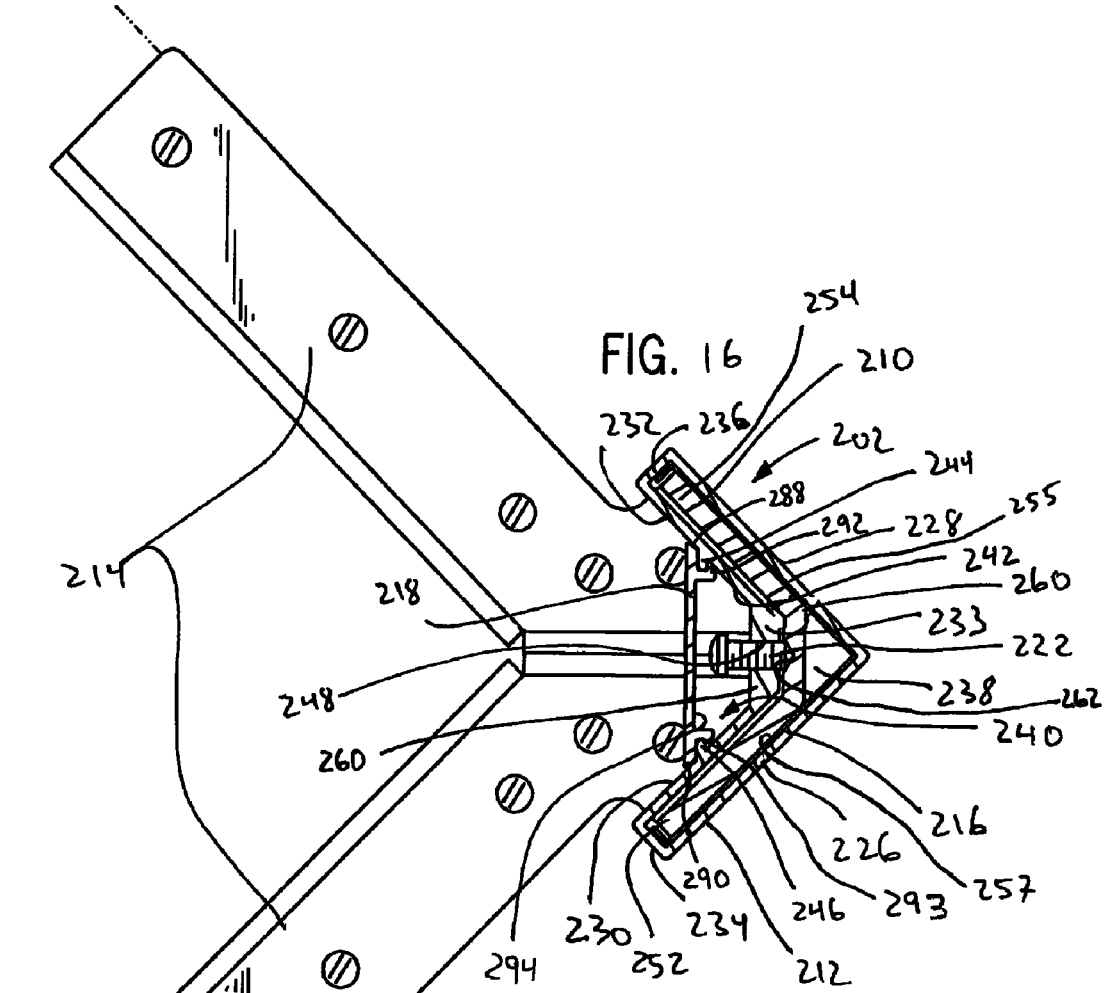
FIG. 16 is a cross-sectional view taken along the line 16-16 of FIG. 15.
Figure 17:
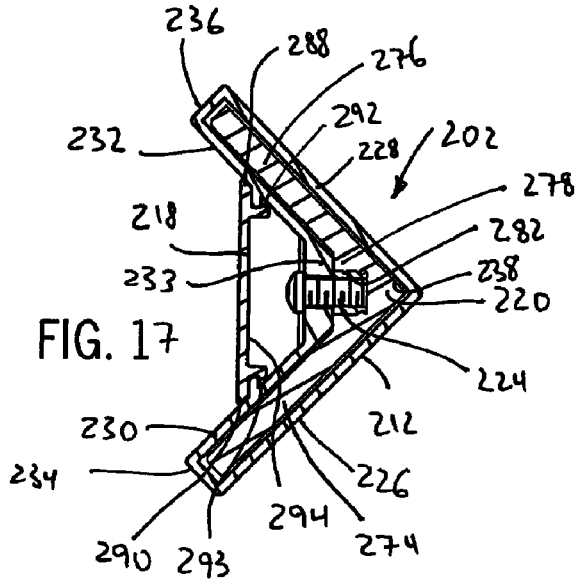
FIG. 17 is a cross-sectional view taken along the line 17-17 of FIG. 15.

Referring still to FIG. 1 and now also to FIGS. 12 through 17, leg assembly 202 includes a first elongated member 212, a second elongated member 210, a mounting bracket assembly 214, a finished cover member 216, a channel cover member 218, a foot member 220, incremental adjustment screws or fasteners 222, fine adjustment bolts 224 and nuts 225. First elongated member 212, as the label implies, is an elongated rigid member that extends from a first end 227 to a second end 229 and generally has a uniform shape in cross-section along its entire length as best illustrated in FIGS. 16 and 17. Referring specifically to FIGS. 16 and 17, in cross section, elongated member 212 includes a first planar external or outer wall member 226, a second planar external or outer wall member 228, a first planar internal or inner wall member 230, a second planar internal or inner wall member 232, an intermediate wall member 233 and first and second end wall members 234 and 236, respectively.

External wall members 226 and 228 are integrally formed along one long edge thereof and extend away from each other so as to form a substantially 90 degree angle. Along long edges of members 226 and 228 opposite the other of members 226 and 228, first and second end walls members 234 and 236 are integrally formed with walls 226 and 228 and extend therefrom so as to form substantially 90 degree angles such that wall member 236 is substantially parallel with wall member 226 and wall member 234 is substantially parallel with wall member 228. Along the long edge of end wall member 236 opposite member 228, internal wall member 232 is integrally formed so as to extend at substantially a 90 degree angle from member 236 and substantially parallel to and spaced apart from wall member 228. Similarly, wall member 230 extends at substantially a 90 degree angle from, and is integrally formed with, the long edge of member 234 opposite member 226. Wall member 233 is integrally formed at an edge of internal wall member 232 opposite end member 236 and is also integrally formed along a long edge of internal member 230 opposite end member 234 so as to form substantially 135 degree angles with each of members 232 and 230.

Figure 13:
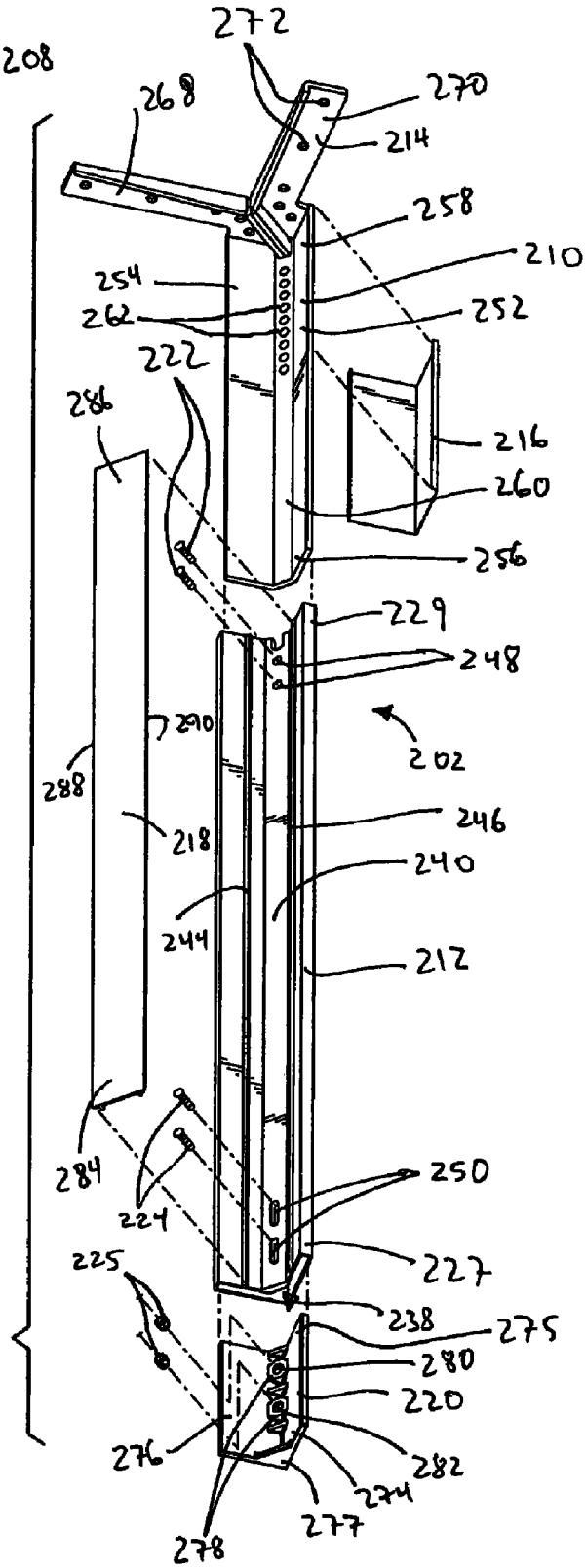
FIG. 13 is an exploded view of the leg assembly of FIG. 12, albeit not attached to the undersurface of a table top.

In at least some embodiments intermediate wall member 233 is thicker than the other wall members that form first elongated member 212. Thus, as illustrated and as described above, the wall members that form first elongated member 212 form an internal L or V shaped channel 238 and an external surface 242 of wall members 230, 232 and 233 forms an external channel 240 that is open to one side. As best seen in FIGS. 13, 16 and 17, first and second ribs 244 and 246, respectively, are formed on surface 242, rib 244 being formed about midway between intermediate member 233 and end member 236 and rib 246 being formed about midway between intermediate member 233 and end member 234. Ribs 244 and 246 extend along the entire length of elongated member 212 (see specifically FIG. 13).

Referring now to FIG. 13, proximate first end 227, intermediate member 233 forms a pair of slots collectively identified by numeral 250 where the slots extend along a trajectory parallel to the length dimension of member 212 and are aligned so that one slot is vertically above the other slot when member 212 is oriented for operation. Intermediate member 233 also forms a pair of threaded adjustment bores or openings collectively identified by numeral 248 proximate second end 229.

Referring now to FIGS. 13, 15 and 16, second elongated member 210 is, as the label implies, an elongated member that extends between a first end 256 to a second end 258. In the illustrated embodiment, member 210 has a uniform cross-section along its length as best illustrated in FIG. 16. To this end, elongated member 210 includes a first lateral member 252, a second lateral member 254 and an intermediate member 260. Intermediate member 260 has first and second long edges that are integrally formed along similar long edges of members 252 and 254 such that, in cross-section, intermediate member 260 extends at a substantially 135 degree angle from each of members 252 and 254. As illustrated in FIG. 16, the members that form second elongated member 210 are dimensioned such that elongated member 210 is receivable within the internal channel 238 formed by first elongated member 212.

Referring still to FIGS. 13 and 16, intermediate member 260 forms a plurality of incremental adjustment recesses, two of which are collectively identified by numeral 262 in FIG. 13 and one of which is identified by numeral 262 in FIG. 16. The recesses 262 are formed in a line so as to extend along a portion of the length of member 210 and are positioned proximate second end 258 of member 210. The spacing between recesses 262 is such that, different pairs of the recesses 262 are alignable with the openings 248 formed at end 229 of member 212 (see specifically FIG. 15 in this regard).

Finished cover member 216 is similar to the finished cover 78 illustrated in FIG. 3 and is provided for aesthetic purposes only. To this end, cover member 216 is formed and dimensioned to be able to be mounted or secured in some fashion (e.g., mechanically, via adhesive, etc.) to the external surface of second end 258 of member 210 so that, when a top portion proximate end 258 of member 210 is exposed, the exposed portion has a finished appearance.

Referring to FIGS. 12, 13, 15 and 17, foot member 220 is a generally elongated member that extends between top and bottom ends 275 and 277, respectively, and includes first and second rectangular lateral members 274 and 276 that are integrally formed along long edges thereof and that extend away from each other at substantially a right angle. Two corner web members (collectively labeled 278) are formed along the seam between lateral members 274 and 276 and form openings 280 and 282 for receiving nuts 225. Members 274 and 276 are dimensioned such that top end 275 of member 220 is receivable in channel 238 formed by member 212 at first end 227.

Referring now to FIGS. 13, 16 and 17, channel cover member 218 is an elongated, resilient yet flexible member that extends between first and second ends 284 and 286, respectively, has first and second oppositely facing lateral edges 288 and 290, respectively, and forms an internal surface 294. Proximate lateral edge 288, cover member 218 forms first rib 292 that extends substantially along its length. Similarly, proximate lateral edge 290, cover member 218 forms a second rib 293 along its entire length. As illustrated in FIGS. 16 and 17, cover member 218 is dimensioned such that edges 288 and 290 define a dimension which is substantially equal to the dimension between ribs 244 and 246 formed by member 212 so that, when cover member 218 is pressed against surface 242 with ribs 292 and 293 in contact with ribs 244 and 246, ribs 292 and 293 compress slightly and cover member 218 is held in place to close external channel 240 by a compression or friction fit. In at least some embodiments cover member 218 will also include ribs (not labeled) at distal ends of ribs 292 and 293 that extend outward in the same direction as edges 288 and 290 where the cover ribs are captured between ribs 244 and 246 and adjacent surface portions of member 212 when the cover member 218 is installed.

Figure 12:
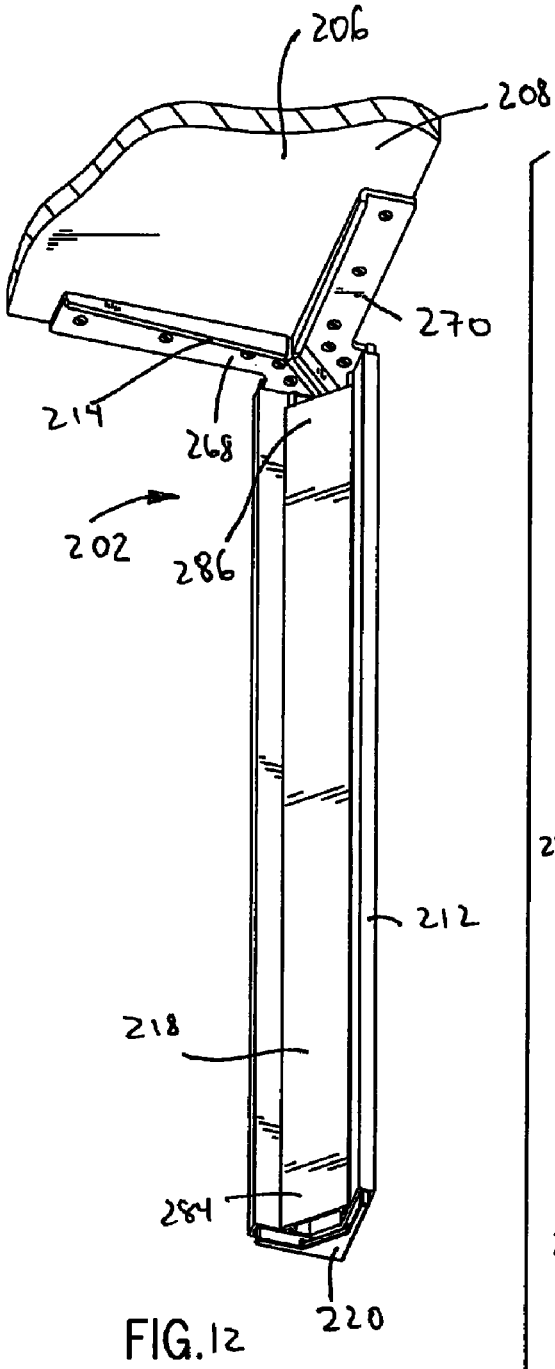
FIG. 12 is a perspective view of one of the leg assemblies of FIG. 1 attached to the undersurface of a table top.

Bracket assembly 214 includes two elongated members 268 and 270 as best seen in FIGS. 12 and 13 that extend from each other so as to form an approximately right angle. Each of members 268 and 270 forms a plurality of mounting holes for securing assembly 214 to an undersurface 208 of a tabletop member 206 (see specifically FIG. 12). In some embodiments, bracket assembly 214 is secured to an end of second elongated member 210, while in some embodiments bracket assembly 214 is secured to an end of the first elongated member 212.

To assemble leg assembly 202, nuts 225 are secured (e.g., via epoxy, ultra-sonic welding, etc.) in nut receiving apertures 280 and 282 formed by foot member 220. Next, the top end 275 of foot member 220 is inserted in channel 238 formed at first end 227 of first member 212. Screws 224 are inserted through slots 250 and are threadably received within the nuts 225 that reside in channel 238.

Continuing, with finished cover member 216 attached to member 210 proximate end 258, first end 256 of member 210 is inserted into channel 238 at second end 229 until threaded holes 248 are aligned with a pair of the recesses 262 formed by member 210. Screws 222 are threadably received in holes 248 and are tightened so that the distal ends of screws 222 are received within a pair of the recesses 262 (here the surface forming recesses 262 is referred to as a fastener engaging bearing surface) forcing an outward facing channel engaging surface 255 of member 210 against a facing inner or internal channel bearing surface 257 formed by members 226 and 228 (see FIG. 16).

Next, screws (not labeled) are used to secure bracket assembly 214 to the undersurface 208 of a top member 206 to be supported by leg assembly 202. In at least some cases bracket assembly 214 is mounted to an undersurface 208 proximate a peripheral edge of the top member 206 with the external channel 240 (see again channel 240 in FIG. 16) facing away from the peripheral edge and facing a space below the top member. Now, to adjust tabletop height, initially incremental height adjustment can be affected by loosening screws 222, sliding telescoping member 210 within channel 238 until a desired pair of recesses 262 are aligned with threaded apertures 248 and then retightening screws 222. Once incremental adjustment has been completed, fine height adjustment is affected by loosening screws 224, raising/lowering the tabletop 206 and the assembly including first and second elongated members 212 and 210 so that, as top 206 and members 212 and 210 are raised and lowered, foot member 220 slides within channel 238. Once a desired height has been precisely achieved, screws 224 are tightened to lock member 212 with respect to foot member 220. To this end, as screws 224 are tightened, surfaces of corner web members 278 facing the internal surface of intermediate member 233 are pulled against the internal surface of member 233 until movement of member 220 in channel 238 is inhibited. This height adjusting process is repeated for all leg assemblies.

Finally, channel cover members 218 are mounted to members 212 to cover channels 240. Here, cover members 218 serve several purposes. First, cover member 218 blocks sight of screws 222 and 224 that reside within channel 240. Second, where cover member 218 has a length dimension less than the length of member 212, when cover member 218 is installed, gaps may be provided at the top and bottom ends of the cover member so that cables, wires, etc., running from the floor to a worksurface supported by the leg can be hidden.

Figure 18:
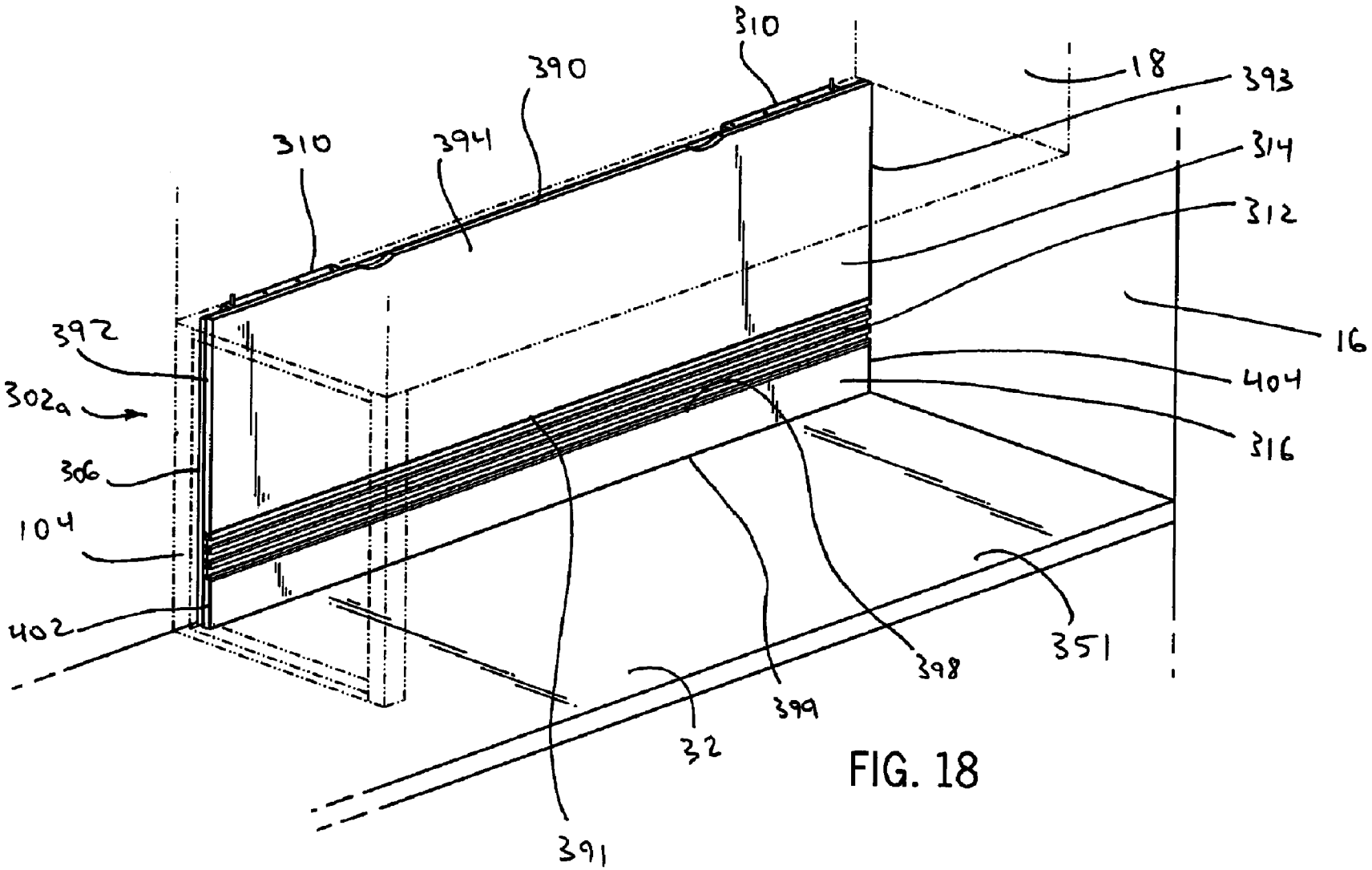
FIG. 18 is a perspective view of a wall assembly of FIG. 1 where a shelf/cabinet assembly and the foot assembly are shown in phantom and tackboard inserts or filler members are included.
Figure 19:
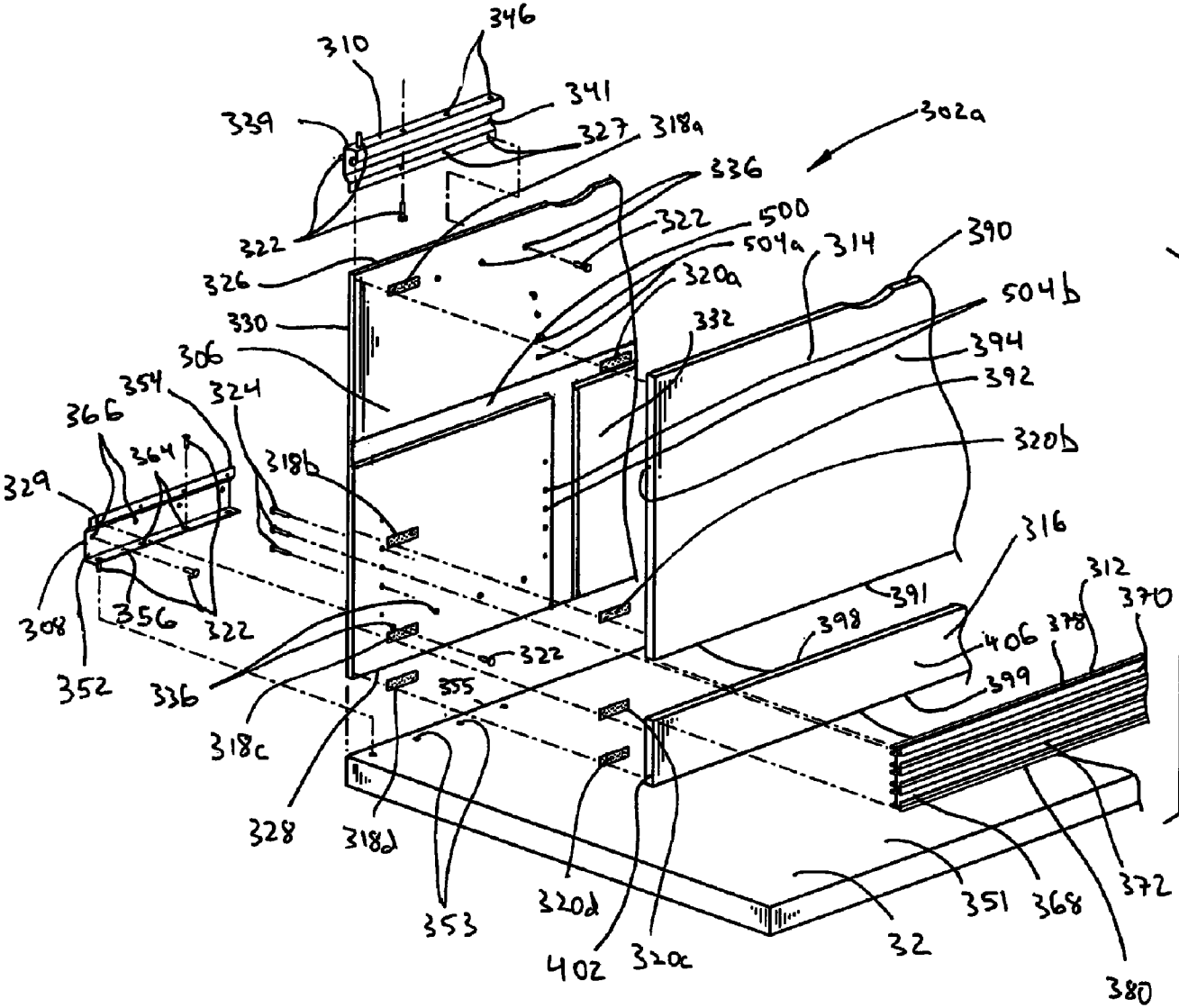
FIG. 19 is an exploded view of a portion of the wall assembly of FIG. 18.
Figure 20:
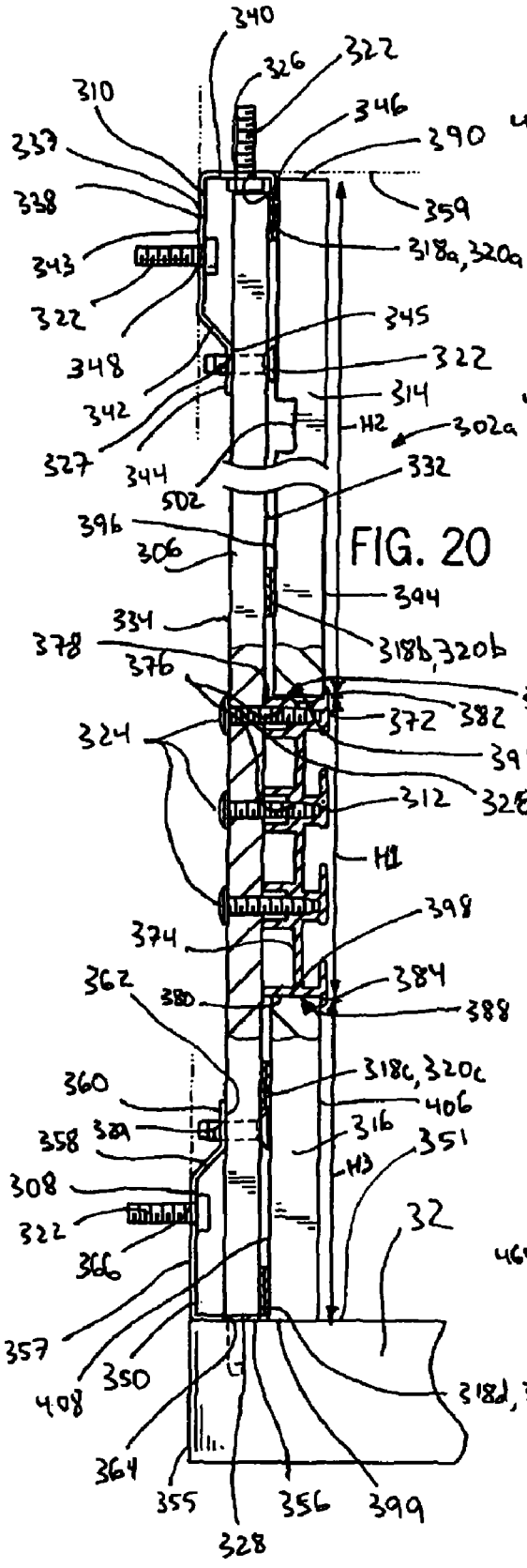
FIG. 20 is a side view shown in part in cross-section of the wall assembly of FIG. 18.

Referring once again to FIG. 1, another inventive aspect is related to the wall assembly 302*a* that resides between foot support assembly 104 and closet unit 16 and resides between shelf/cabinet assembly 18 and work surface 32. Referring also to FIGS. 18, 19 and 20, exemplary wall or panel assembly 302*a* includes a solid backer member 306, a work surface mount bracket 308, a cabinet mount bracket 310, a slat wall segment 312, an upper filler member 314, a lower filler member 316 and perpendicular trajectory coupling components including, in the illustrated embodiment, first Velcro segments including segments 318*a*, 318*b*, 318*c*, 318*d*, and other first Velcro segments that are not illustrated and second Velcro segments including segments 320*a*, 320*b*, 320*c*, 320*d*, and other second segments that are not illustrated. In addition, wall assembly 302*a* also includes a plurality of mounting screws 322 and slat wall attaching screws 324.

Herein, while various types of perpendicular trajectory coupling components are contemplated, the inventions will be described in the context of configurations that include Velcro type attaching assemblies that include complimentary first and second hook and loop type connector strips. Nevertheless it should be appreciated that when the term Velcro is used, the components associated therewith may be replaced by any type of perpendicular trajectory coupling component that allows surfaces of associated components to be connected and released by moving one of the surfaces toward the other of the surfaces along a trajectory that is perpendicular to both of the surfaces. For instance, where Velcro connectors are employed, in at least some embodiments quick release tape products may be used instead. In this regard, for example, 3M has developed a two sided tape that is releasable from joined surfaces when an edge tab at the edge of the tape strip is pulled. Here, when the tab is pulled, the tape stretches and the adhering capability of the tape is reduced so that the joined surfaces can be pulled apart along a trajectory that is substantially perpendicular to the surfaces. In at least some embodiments releasable type tapes may be used instead of a Velcro type product to joint components together. Other types of quick release perpendicular trajectory coupling components are contemplated.

Referring still to FIGS. 18, 19 and 20, backer member 306 is a rigid substantially rectilinear member having a top edge 326, a bottom edge 328, a first lateral edge 330 and a second lateral edge (not shown or labeled). Backer member 306 includes oppositely facing front and rear surfaces 332 and 334, respectively, and forms a plurality of mounting holes, several of which are collectively identified by numeral 336 in the figures, where each mounting hole passes from the front surface 332 through to the rear surface 334. Backer member 306 has height and width dimension such that the backer member extends from foot support assembly 104 to closet unit 16 and from an undersurface 359 of shelf/cabinet assembly 18 to a top surface 351 of work surface 32 (see FIG. 1).

Referring still to FIGS. 19 and 20, cabinet mount bracket 310 is an elongated member that extends between a first end 339 and a second end 341 and has a substantial uniform cross section along its entire length. In at least some embodiments, bracket 310 will be formed of bent sheet metal or plastic and will be substantially rigid although, in at least some embodiments, it may be slightly flexible yet resilient. As best illustrated in FIG. 20, in cross section, bracket 310 includes a wall mount or first arm member 338 and a cabinet mount or shoulder member 340 where arm member 338 includes a proximal arm member 337, a separator or elbow member 342 and a backer support or distal arm member 344. Each of members 338, 340, 342, and 344 is a substantially rectilinear and planar member having two short edges and two long edges (not labeled).

A first long edge of shoulder member 340 is integrally formed with a first long edge of member 337 such that member 340 extends at a substantially 90-degree angle from member 337. The edge of member 337 opposite shoulder member 340 is integrally formed with a first long edge of separator member 342 and member 342 extends generally in the same direction as member 340 away from member 337, albeit at an approximately 135-degree angle. Distal arm member 344 is integrally formed with member 342 along a second long edge thereof and extends at an approximately 135-degree angle away from member 340 and member 344 is substantially parallel with member 337. Proximal arm member 337 forms a rear surface 343 which faces in a direction opposite the direction in which member 340 extends while member 344 forms a bearing or first facing surface 345 that faces in a direction opposite the direction in which rear surface 343 faces. Member 337 forms a plurality of mounting holes 348 that are substantially equi-spaced along its length. Member 344 forms a plurality of bores 327 (i.e., self-tapping holes) along its length. Similarly, member 340 forms a plurality of mounting holes 346 that are substantially equi-spaced along its length. In at least some embodiments, the wall assembly 302*a* will include two or more brackets 310 (see FIG. 18).

Referring still to FIGS. 19 and 20, work surface mount bracket 308 is configured in a fashion similar to bracket 310 and therefore will not be described here again in detail. Here, it should suffice to say that bracket 308 extends from a first end 352 to a second end 354 and includes a wall mount or proximal arm member 350, a shoulder or work surface mount member 356, a separator or elbow member 358 and a backer support or distal arm member 360, where member 350 forms mounting holes 366 along its length, member 356 forms mounting holes 364 along its length and member 360 forms a plurality of bores 329 along its length. Although only one bracket 308 is shown, in at least some embodiments, assembly 302*a* will include two more brackets 308.

Referring yet again to FIGS. 19 and 20, slat wall segment 312 is an elongated and, in at least some embodiments, extruded member that extends from a first end 368 to a second end 370 and that has a substantially uniform cross section along its length. As best shown in FIG. 20, in cross-section slat wall segment 312 includes a front surface 372 and a rear surface 374 where the front surface 372 forms slat wall-type receiving channels as well known in the art. Segment 312 forms slots to accept self-tapping screws that are collectively identified by numeral 376 in FIG. 20 in rear surface 374. Slat wall segment 312 includes a top edge 378, a bottom edge 380, an upper lip 382 that extends upward from the top edge 378 adjacent front surface 372 and a lower lip 384 that extends downward from the bottom edge 380 adjacent front surface 372.

Referring once again to FIGS. 18, 19 and 20, upper filler member 314 is a substantially rigid rectilinear and planar member that includes a top edge 390, a bottom edge 391, first and second lateral edges 392 and 393, respectively, a front surface 394 and a rear surface 395. Similarly, lower filler member 316 is a rigid planar and substantially rectilinear member that includes a top edge 398, a bottom edge 399, first and second lateral edges 402 and 404, respectively, and front and rear surfaces 406 and 408, respectively. Front surface 394 and 406 of filler members 314 and 316 may be finished in any of several different ways including cloth, wood veneer, a plastic finish, etc. In at least some embodiments both the front and rear surfaces of members 314 and 316 may be finished in different ways so that an installer can select either finish to be exposed after installation. For instance, the front surface 394 may have a cloth finish while rear surface 396 has a wood veneer finish.

Referring specifically to FIG. 20, slat wall segment 312 has a height dimension H1 while upper and lower filler members 314 and 316 have height dimensions of H2 and H3, respectively, where the combined heights H1, H2, and H3 are similar to or substantially identical to the height (not labeled) of backer member 306 that extends between the top surface 351 of work member 32 and undersurface 359 shelf/cabinet assembly 18 there above.

Referring yet again to FIGS. 18, 19 and 20, to assemble the wall assembly 302*a*, mounting holes 353 are formed in the top surface 351 of work surface member 32 adjacent rear edge 355 as illustrated where the pattern of holes 353 matches the pattern of holes 364 formed in member 356 of bracket 308. Similarly, mounting holes (not illustrated or labeled) in the pattern of holes 346 formed by member 340 of bracket 310 are formed in the undersurface 359 of the shelf/cabinet assembly 18 near the rear surface thereof. In addition to or instead of forming the holes in top surface 351 and undersurface 359, holes may be formed in a vertical wall that rear surface 334 of backer member 306 will face after installation is complete where the wall mounting holes are formed in patterns that mirror the patterns of holes 348 and 366 formed by member 338 of bracket 310 and member 350 of bracket 308, respectively.

Brackets 308 and 310 are mounted to the top surface 351 of work member 32 and to the undersurface 359 of shelf/cabinet assembly 18 and/or are mounted to a wall surface via screws 322 as illustrated in FIG. 20. Next, self-tapping screws 322 are used to mount backer member 306 to brackets 308 and 310 where the distal ends of the screws 322 are received in bores 327 and 329 formed by members 344 and 360, respectively, where the rear surface 334 of backer member 306 bears against bearing surfaces 345 and 362. Here, because separator members 342 and 358 space the members 344 and 360 away from a wall surface against which the rear surfaces 343 and 357 bear, the distal ends of the screws 322 that connect backer member 306 to brackets 308 and 310 reside in the gap formed by the separator members 342 and 358.

Referring still to FIGS. 19 and 20, slat wall segment 312 is mounted to the front surface 332 of backer member 306 via screws 324 that are received in slots 376. As illustrated, in at least some embodiments, slat wall segment 312 is secured to front surface 332 approximately one-third of the way up between top surface 351 and undersurface 359. Once slat wall segment 312 is mounted to backer member 306, lip 382 and a facing portion of front surface 332 of backer member 306 form an upper receiving space 386. Similarly, lip 384 and a facing portion of surface 332 form a lower receiving space 388.

First Velcro segments 318*a*, 318*b*, 318*c*, 318*d*, and other similar segments are next adhered to the front surface 332 of backer member 306. In the illustrated example, segments 318*a*, 318*b*, 318*c*, and 318*d* are spaced apart on surface 332 with segment 318*a* proximate the top edge 326 of backer member 306, segment 318*b* just above slat wall segment 312, segments 318*c* just below slat wall segment 312, and segment 318*d* just above bottom edge 328.

Continuing, second Velcro segments 320*a*, 320*b*, 320*c*, 320*d*, and other similar second Velcro segments are adhered to the rear surfaces 396 and 408 of the upper and lower filler members 314 and 316, respectively, in patterns that mirror the patterns used to adhere the first Velcro segments (e.g., 318*a*, 318*b*, etc.) to front surface 332 of backer member 306. Here, the labels first and second are used to distinguish complementary Velcro segments where first segments secure to second segments as known in the art. Next, the bottom edge 391 of upper filler member 314 is placed within receiving space 386 and the top edge 390 is rotated toward bracket 310 until the second Velcro segments 320*a* and 320*b* contact and secure to the first Velcro segments 318*a* and 318*b*, respectively. Similarly, the top edge 398 of lower filler member 316 is placed within receiving space 388 and the bottom edge 399 of member 316 is rotated toward bracket 308 until the Velcro segments 320*c* and 320*d* contact and secure to segments 318*c* and 318*d*, respectively.

It should be appreciated that filler members 314 and 316 are easy to install and remove, and, therefore, if a user wishes to change out one or both of members 314 and 316 so that the finished front surfaces 394 and 406 are different, this switching out process can be accomplished relatively easily. It should also be appreciated that a small gap exists between filler members 314 and 316 and backer member 306 after installation due to the Velcro where wires, lines, etc., can be hidden from sight when desired. In at least some embodiments, it is contemplated that the front surface 332 of backer member 306 and/or the rear surface of one or both of members 314 and 316 may form wire/cable passing channels to further facilitate wire and line passage. To this end see channels 500 in FIG. 19 and exemplary channel 502 in FIG. 20.

Figure 21:
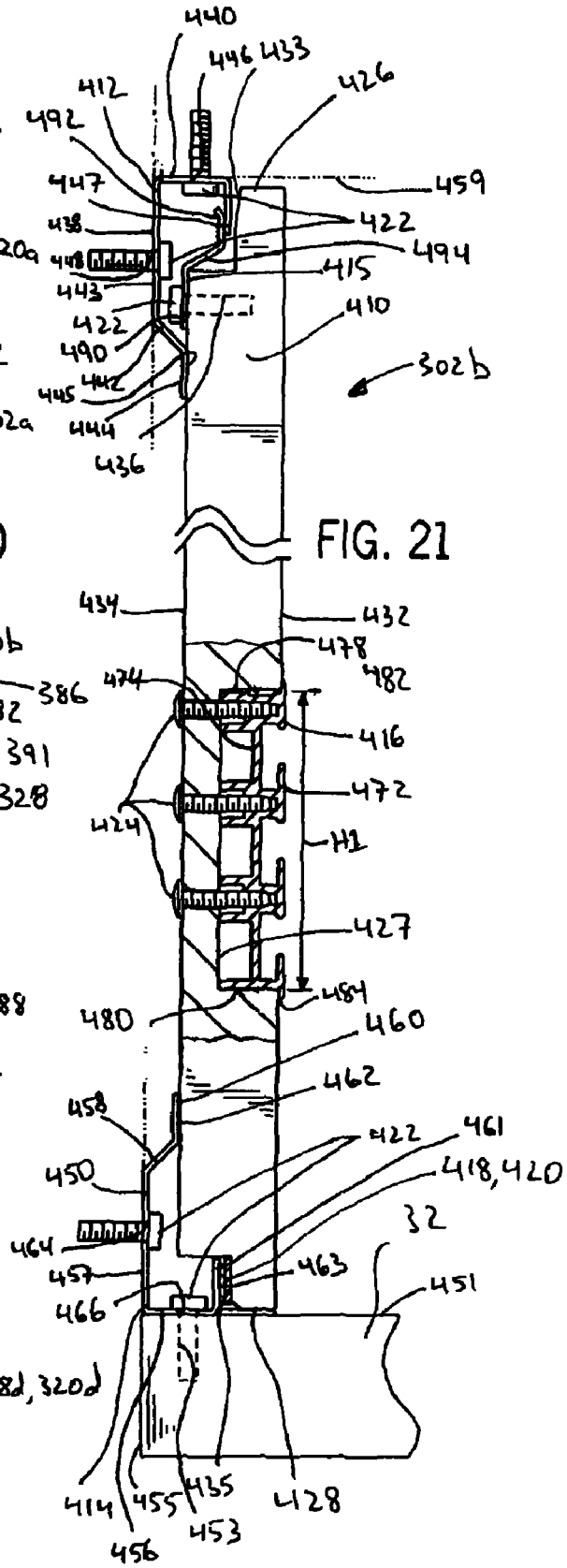
FIG. 21 is similar to FIG. 20, albeit illustrating a second wall assembly embodiment that does not include tackboards or filler members.
Figure 22:
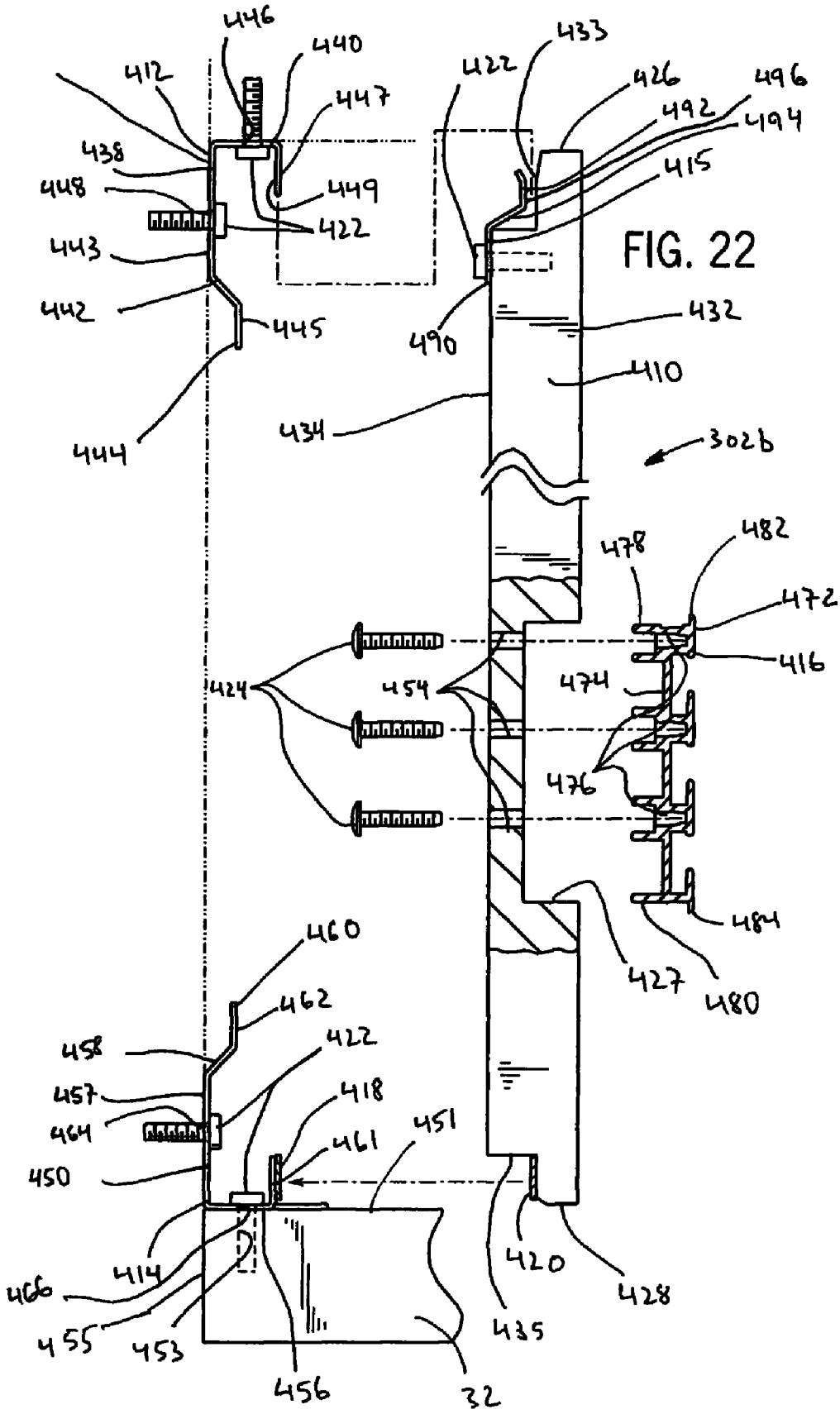
FIG. 22 is an exploded side view of the wall assembly of FIG. 21.

Referring now to FIGS. 21 and 22, a second wall assembly embodiment 302*b* is illustrated. The second wall assembly 302*b* is similar to first assembly 302*a* shown in FIGS. 19 and 20 in several respects. To simplify this explanation, similar or identical structures in this second wall assembly embodiment will not be described again here in detail.

Referring to FIGS. 21 and 22, exemplary second wall assembly embodiment 302*b* includes a panel assembly including one or more clips 415 mounted to a backer member 410, a work surface mount bracket 414, a cabinet mount bracket 412, a slat wall segment 416, first Velcro segments, only one illustrated and labeled 418, second Velcro segments, only one illustrated and labeled 420, mounting screws 422 and slat wall attaching screws 424. Backer member 410 is a rigid substantially rectilinear and planar member having a top edge 426, a bottom edge 428, first and second lateral edges (not labeled or illustrated), a front surface 432, and a rear surface 434. Backer member 410 forms a top channel or recess 433 along top edge 426 that opens to rear surface 434. Similarly, backer member 410 forms a bottom channel or recess 435 that opens to rear surface 434. Just below top channel 433, backer member 410 forms a plurality of bores 436.

Referring still to FIGS. 21 and 22, backer member 410 forms a routed channel 427 in front surface 432. As illustrated, channel 427 is dimensioned to receive slat wall segment 472. In at least the illustrated embodiment, the routed channel 427 is approximately one-third of the way between bottom backer edge 428 and top backer edge 426. As best seen in FIG. 1, in this second embodiment, channel 427 extends between the lateral edges of backer member 410.

Referring once again to FIGS. 21 and 22, clip 415 includes a first member 490, a second member 492 and an intermediate member 494. Each of members 490, 492, and 494 is a substantially planar rectilinear member having two short edges and two long edges. The first and second long edges of intermediate member 494 are integrally formed with first long edges of each of the first and second members 490 and 492, respectively, where member 494 is angled with respect to each of members 490 and 492 and where members 490 and 492 are substantially parallel to each other. In the illustrated embodiment, intermediate member 494 forms an approximately 135-degree angle with each of members 490 and 492. When clips 415 are mounted to rear surface 434 of backer member 410, intermediate member 494 and second member 492 extend into channel 433 and forms a first panel assembly portion or clip surface 496 (see FIG. 22).

Referring again to FIGS. 21 and 22 and also to FIG. 20, cabinet mount bracket 412 has a design that is similar to a design of cabinet mount bracket 310. To this end, cabinet mount bracket 412 includes a wall mount or first arm member 438 and a cabinet mount or shoulder member 440, where first arm member 438 includes a proximal arm member that forms rear surface 443, an elbow member 442 and a backer support or distal arm member 444 that forms a bearing surface 445. Members 438, 440, 442 and 444 have dimensions similar to and are juxtaposed in a similar fashion to members 338, 340, 342, and 344 in FIG. 20. The primary difference between bracket 310 and bracket 412 is that bracket 412 includes a second arm or clip member 447 that is generally parallel to member 438 so that bracket 412 is generally U-shaped in cross-section with first and second arm members 447 and 438 that include facing surfaces that form a channel therebetween. Member 447 is a rectilinear planar member having two long edges and two short edges where one of the long edges is integrally formed with the long edge of member 440 opposite member 438 such that member 447 extends from member 440 at a substantially 90-degree angle such that member 447 is substantially parallel with member 438. Member 447 forms a clip surface 449 (see specifically FIG. 22). Member 438 forms a plurality of mounting holes 448 while member 440 forms a similar plurality of mounting holes 446.

Referring still to FIGS. 21 and 22, bracket 414 has a design that is similar to bracket 412, and, therefore, bracket 414 will not be described again here in detail. Here, it should suffice to say that bracket 414 is generally U-shaped and includes first arm member including a wall mount or proximate arm member 450 that forms a rear surface 457, a separator or elbow member 458 and a backer support or distal arm member 460 that forms a bearing surface 462, the bracket 414 also including a work surface mount or shoulder member 456 and a clip or second arm member 461 that is akin to clip member 447 of bracket 412. Members 450 and 456 form mounting holes 464 and 466, respectively, and clip member 461 forms a bearing surface 463 that faces in the same direction as bearing surface 462.

Referring yet again to FIGS. 21 and 22, slat wall segment 416 is constructed in a similar fashion to slat wall segment 312 shown in FIG. 20. To this end, segment 416 is an elongated extruded member that extends from a first end to a second end (not labeled) and includes a top edge 478, a bottom edge 480, a front surface 472 and a rear surface 474. Along the top and bottom edges 478 and 480, segment 416 forms upper and lower lips 482 and 484 proximate front surface 472, respectively. In addition, segment 416 forms slots to accept self-tapping screws that are collectively identified by numeral 476 in FIG. 22 that open to rear surface 474. Segment 416 has a height dimension H1 that is substantially identical to the width of channel 427 (see specifically FIG. 21).

To assemble wall assembly 302*b*, mounting holes are formed in top surface 451 of work surface member 32 and the undersurface 459 of the shelf/cabinet assembly 18 (see FIGS. 1 and 21, specifically) and/or in a wall surface that is to face rear surface 434 of backer member 410 after assembly is completed. Mounting screws 422 are used to mount brackets 412 and 414 to surfaces 451 and 459 and/or to the wall via the mounting holes such that bearing surfaces 445 and 462 are co-planar and face in the same direction. Next, clips 415 are mounted via mounting screws 422 to rear surface 434 of backer member 410 so that intermediate members 494 and second members 492 extend into the upper channel 433 with clip surface 496 spaced apart from a facing surface of channel 433 as illustrated. One clip 415 is mounted to backer member 410 for each of brackets 412. Slat wall segment 416 is placed within channel 427 such that lips 482 and 484 reside on front surface 432. Next, screws 424 are inserted through holes 454 and are threadably received in bores 476 to secure segment 416 in channel 427. First Velcro segments 418 are adhered to clip members 461 and second Velcro segments 420 are adhered to the surface of channel 435 that faces in the direction opposite front surface 432.

The subassembly including backer member 410, clip 415, and slat wall segment 416 is next positioned such that clip member 447 is received within the space between second member 492 of clip 415 and the facing surface of channel 433. Next, the lower end (i.e., the end proximate bottom edge 428) is rotated toward bracket 414 until second Velcro members 420 contact and secure to first Velcro members 418. As the subassembly is rotated, bearing surface 445 comes in contact with rear surface 434 of backer member 410 and clip surface 492 is pressed up against surface 449 of member 447 so that the top end of backer member 410 is secured in place.

One or more specific embodiments of the present invention have been described above. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Thus, the invention is to cover all modifications, equivalents, and alternatives falling within the spirit and scope of the invention as defined by the following appended claims. For example, referring again to FIG. 3, while the pedestal assembly is described as including two adjustment screws 86, 88, in at least some embodiments other types of mechanical locking mechanisms are contemplated for locking the position of member 76 within channel 60. For instance, spring loaded pins may be employed instead of screws 86, 88.

In addition, in at least some embodiments less than four telescoping members may be required in the pedestal support configuration.

Moreover, in some embodiments, referring again to FIGS. 19 and 20, backer member 306 may include holes 504*a* and 504*b* to accommodate the slat wall segment 312 at two different heights where, when segment 312 is mounted at the lower height via holes 504*b* (see FIG. 19), filler members 314 and 316 are mounted above and below segment 312 and, when segment 312 is mounted at the upper height via holes 504*a*, filler members 314 and 316 are mounted below and above segment 312, respectively. This feature enables an assembly installed to place the slat wall segment at either of two heights to accommodate different user preferences.

Furthermore, in some embodiments a single screw may be used to secure each pair of members 106, 108, 112 and 110 together instead of two screws 122 as shown in FIG. 7.

In addition, while foot support assembly is shown in FIGS. 6-11 as including vertical members 106 and 108 that form end channels for receiving ends of horizontal members, in at least some embodiments the horizontal members 110 and 112 may form end channels for receiving ends of vertical members 106 and 108.

Figure 23:
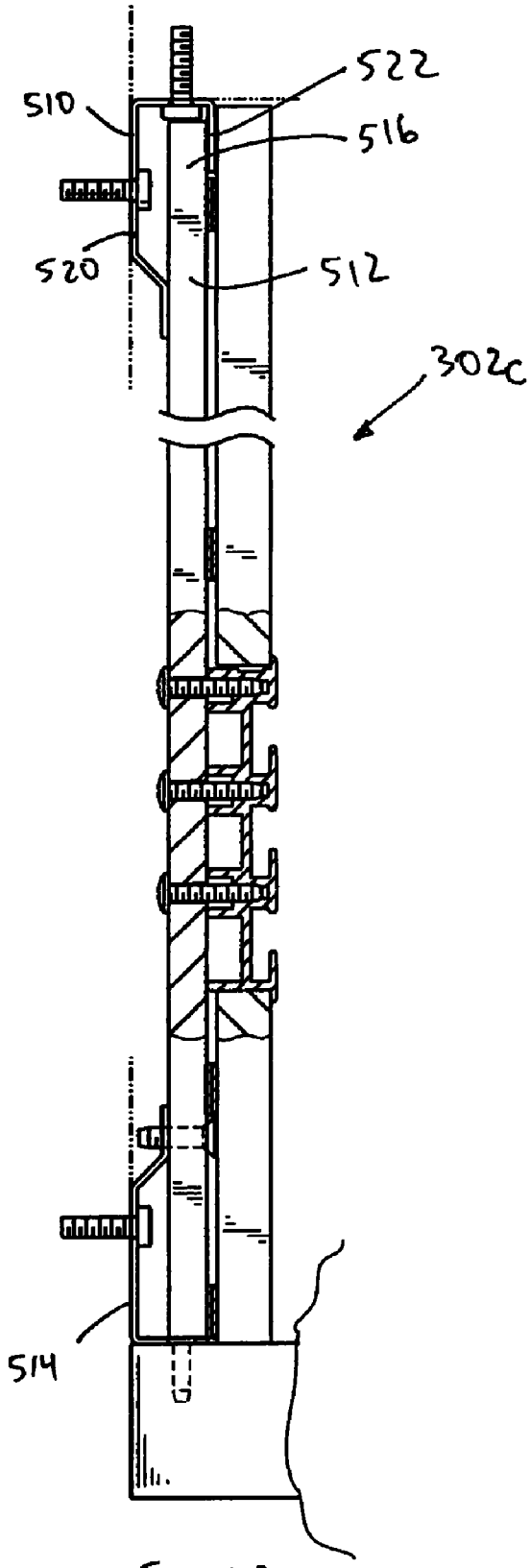
FIG. 23 is similar to FIG. 20, albeit illustrating a third wall assembly embodiment.

Moreover, in at least some embodiments a hybrid design of the panel/wall assemblies shown in FIGS. 18-22 may be constructed that uses features of both embodiments. For instance, referring to FIG. 23, in another embodiment 302*c*, top brackets 510 for a backer member 512 may have the form of bracket 412 while the bottom brackets 514 have the form of bracket 308 where backer member 512 has the form of member 306. Here, instead of placing clip 415 in the channel between arm members 447 and 438 as in FIG. 21, the top end 516 of backer member 512 can be placed between bracket arms 520 and 522 to secure the top end of member 512. Thus, here the screws 322 received in threaded bores 327 in FIG. 20 can be eliminated.

In all of the wall or panel assembly embodiments described above it should be appreciated that the assemblies can be configured without requiring access from the space behind the assembly. Thus, referring again to FIG. 20, brackets 308 and 310 are mountable to a wall structure and/or to surfaces 351 and 359 via screws 322 where screw heads are accessible from an area adjacent the front of work surface 32 (i.e., the screw heads face or are adjacent the rear surface of backer member 306 after backer installation and the shafts extend away from backer member 306). Similarly, backer member 306 mounts to brackets 308 and 310 via front accessible screws (i.e., heads of screws to mount backer member 306 to the brackets face or are adjacent the rear surfaces of filler members 314 and 316 with shafts extending away from members 314 and 316). Because Velcro or some other perpendicular trajectory coupling component is used to mounting filler members 314 and 316 to backer member 306, mounting and dismounting of members 314 and 316 can also be from a location adjacent the front of member 32. Similarly, referring to each of FIGS. 21 and 23, each of the panel assemblies 302*b* and 302*c* can be completely installed from a location in front of member 32.

Figure 24:
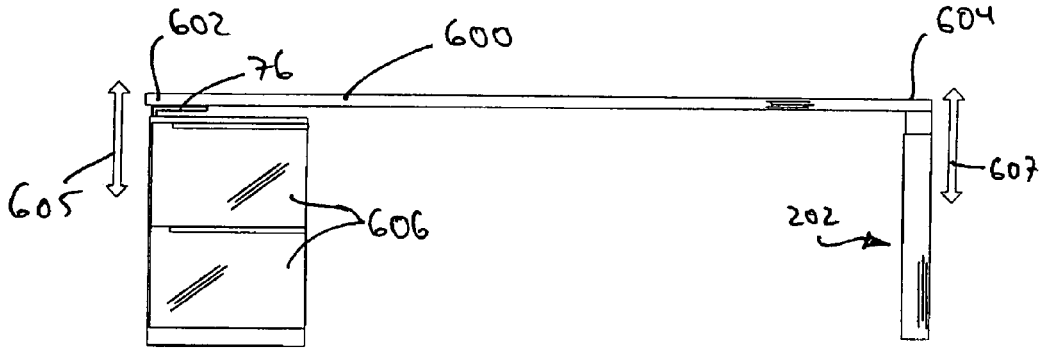
FIG. 24 is a front plan view of a desk assembly including an adjustable pedestal support similar to the support shown in FIGS. 1-5 and a leg support like the leg shown in FIGS. 12-16.

As another example, in at least some embodiments it is contemplated that at least a subset of the components described above as comprising the pedestal support structure shown in FIGS. 2-5 may be combined with other structure to support a work surface. For instance, referring to FIG. 24, in at least some embodiments, a subset of the support structure components shown in FIGS. 2-5 may be used to support one end 602 of a work surface forming member 600 while the opposite end 604 is supported by telescoping leg assemblies 202 akin to the leg assemblies described above with respect to FIGS. 12-17 (or by other adjustable leg assemblies for that matter) so that both ends 602 and 604 can be height adjusted as indicated by arrows 605 and 607, respectively. In this regard, as shown in FIG. 24, only one telescoping member 76 is shown that extends upward from a two drawer stack 606. It should be understood that a second member akin to member 76 may extend upward from stack 606 and may be hidden behind member 76 as illustrated.

In FIG. 24, in at least some embodiments, referring again to FIG. 2, and also to FIG. 24, it may be that only one of the lateral members (e.g., member 36 forms channels 58 and 60 receiving telescoping member 76. In addition, in at least some embodiments it may be that member 38 instead of member 36 forms the member receiving channels so that the telescoping members extend up to the undersurface of the table top 600 at a location spaced apart from the edge adjacent end 602.

Figure 25:
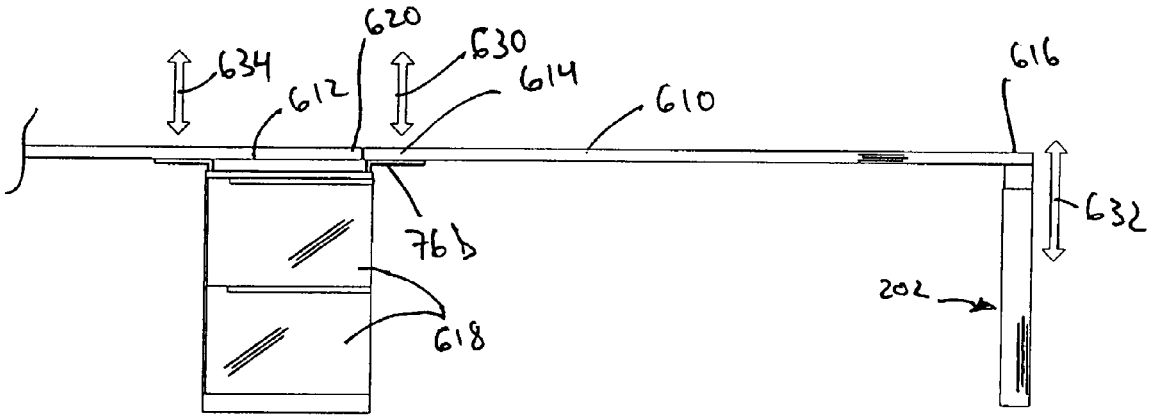
FIG. 25 is a view similar to FIG. 24, albeit showing a different desk assembly.

Referring to FIG. 25, one additional desk configuration is illustrated that includes first and second work surface forming top members 610 and 612, pedestal support assemblies 34 akin to the assemblies described above with respect to FIGS. 2-5 and leg assemblies 202 akin to the leg assemblies of FIGS. 12-17 or other height adjustable leg assemblies. In FIG. 25, top member 610 is supported by one or two telescoping members 76*b* at a first end 614 and by leg assemblies 202 at a second end 616 in a fashion similar to member 600 in FIG. 24. However, in FIG. 25, members extend upward from a lateral member akin to member 38 in FIG. 2 so that top member 610 only extends part way above two drawer stack 618.

Referring still to FIG. 25, second top member 612 includes a first end 620 that is supported by one or two additional telescoping members 76*a* that extend upward from the lateral member akin to member 36 in FIG. 2 and an edge of member 612 at end 620 is adjacent the first end of member 610 as illustrated. The end of member 612 opposite end 620 is not illustrated but would, in most cases, be supported by some other height adjustable support structure (e.g., another pedestal support, an adjustable leg, adjustable height mounting brackets that secure to a panel wall or closet unit, etc.). Thus, both ends of top member 610 are adjustable as represented by arrows 630 and 632 and top member 612 is likewise separately height adjustable as indicated by arrow 634.

To apprise the public of the scope of this invention, the following claims are made:

What is claimed is:

1. An adjustable length leg assembly for use with a table top member having an undersurface, the leg assembly comprising:

a first elongated member having a length dimension between first and second oppositely extending ends, including an external surface, forming an internal channel that extends at least part way along the length dimension at the first end, the internal channel enclosed along at least a portion of a length dimension of the internal channel, the elongated member forming at least a first opening that opens into the internal channel proximate the first end;

a second elongated member having a length dimension between first and second oppositely extending ends, wherein the second end of the second elongated member is telescopically receivable within the internal channel in at least first and second positions and wherein one of the first end of the second elongated member and the second end of the first elongated member is mounted to the undersurface of the top member;

at least a first fastener extending through the first opening and into the channel, the first fastener operable to engage the second elongated member in the channel to retain the second elongated member in any of the at least first and second positions with respect to the first elongated member; and a cover member supported by the external surface of the first elongated member proximate the first opening so as to impede view of the fastener.

2. The assembly of claim 1 wherein a portion of the external surface of the first elongated member forms an external channel, the first opening extends from the external channel to the internal channel and wherein the cover is supported within the external channel.

3. The assembly of claim 2 wherein the external surface forms ribs that extend within the external channel and wherein the cover member engages the ribs.

4. The assembly of claim 3 wherein the cover member is resiliently deformable and includes first and second lateral edges that engage the ribs to retain the cover member within the external channel.

5. The assembly of claim 4 wherein the portion of the first elongated member that forms the external channel includes first and second substantially flat internal wall members and a substantially flat intermediate wall member that links the first and second internal wall members together, the first and second internal wall members forming first and second wall surfaces and the intermediate wall member forming the opening, the first and second wall surfaces forming the ribs.

6. The assembly of claim 5 wherein the first and second internal wall members are substantially perpendicular to each other.

7. The assembly of claim 5 wherein the internal channel is substantially L-shaped in cross section and forms an internal channel bearing surface, the second elongated member is substantially L-shaped in cross section and forms fastener and channel engaging bearing surfaces, the opening is threaded, the fastener includes a threaded shaft having internal and external ends, the shaft is received in the threaded opening with the internal end of the shaft engaging the fastener engaging bearing surface with the channel engaging bearing surface bearing against the internal channel bearing surface.

8. The assembly of claim 7 wherein the fastener engaging bearing surface forms recesses along a portion of the length of the second elongated member for receiving the internal end of the shaft.

9. The assembly of claim 1 wherein the first elongated member forms a second opening and wherein the assembly further includes a second fastener that extends through the second opening to engage the second elongated member.

10. The assembly of claim 9 wherein the openings are threaded and wherein the fasteners include bolts threadably received within the openings.

11. The assembly of claim 1 wherein the second elongated member is mounted to the undersurface of the top member.

12. An adjustable length leg assembly for use with a table top member having an undersurface, the leg assembly comprising:

a first elongated member having a length dimension between first and second oppositely extending ends, forming internal and external channels that extend at least part way along the length dimension at the first end, the internal channel enclosed along at least a portion of a length dimension of the internal channel, the elongated member forming at least a first opening that opens from the external channel into the internal channel proximate the first end;

a second elongated member having a length dimension between first and second oppositely extending ends, wherein the second end of the second elongated member is receivable telescopically within the internal channel in at least first and second positions and wherein one of the first end of the second elongated member and the second end of the first elongated member is mounted to the undersurface of the top member; and at least a first fastener including internal and external oppositely extending ends, the first fastener positionable with the external end accessible from within the external channel and the internal end located within the internal channel and engaging the second elongated member within the channel to maintain the second elongated member in any of the at least first and second positions with respect to the first elongated member.

13. The assembly of claim 12 wherein the external end of the fastener is disposed within the external channel.

14. The assembly of claim 13 wherein the external channel is open along at least one side thereof.

15. The assembly of claim 14 further including a cover member for closing the open side of the external channel, the cover member mountable within the external channel.

16. The assembly of claim 15 wherein the cover member is formed of resilient plastic.

17. The assembly of claim 12 wherein the external channel is a concave substantially V-shaped channel.

18. The assembly of claim 17 wherein the external channel is substantially L-shaped.

19. The assembly of claim 12 wherein the opening is threaded, the fastener includes a threaded shaft and wherein the internal end of the shaft bears against the second elongated member and presses the second elongated member against a bearing surface formed within the internal channel to maintain the position of the second elongated member with respect to the first elongated member.

20. The assembly of claim 19 wherein the first elongated member forms a second threaded opening that opens from the external channel into the internal channel and wherein the assembly further includes a second fastener that extends through the second opening to engage the second elongated member.

21. The assembly of claim 12 wherein the table top member includes a peripheral edge and wherein the second elongated member is mounted to the undersurface of the top member proximate the peripheral edge with the external channel facing away from the peripheral edge and facing a space below the top member.

22. An adjustable length leg assembly in combination with a table top member having an undersurface, the leg assembly comprising:

a first elongated member having a length dimension between first and second oppositely extending ends, the first elongated member including first and second outer wall members, first and second inner wall members, an intermediate wall member and first and second end wall members that form a substantially V-shaped internal channel, the first and second outer wall members linked along adjacent edges and forming an angle, the intermediate wall member linked along one edge to an adjacent edge of the first inner wall member and linked along an opposite edge to an adjacent edge of the second inner wall member where the first and second inner wall members form an angle, the first end wall linking an edge of the first outer wall member opposite the second outer wall member to an edge of the first inner wall member opposite the intermediate wall member such that the first outer wall member and the first inner wall member are substantially parallel, the second end wall linking an edge of the second outer wall member opposite the first outer wall member to an edge of the second inner wall member opposite the intermediate wall member such that the second outer wall member and the second inner wall member are substantially parallel, the intermediate wall member forming at least a first threaded opening that opens into the internal channel;

a second elongated member that includes first and second ends, the second end of the second elongated member including first and second lateral members and an intermediate member, opposite edges of the intermediate member linking the first and second lateral members such that the first and second lateral members form an angle substantially similar to the angle formed by the first and second outer wall members, the second end of the second elongated member telescopically receivable within the internal channel in at least first and second positions; and a fastener including a threaded shaft having internal and external ends, the shaft receivable within the opening with the internal end bearing against the intermediate member and the first and second lateral members bearing against the first and second outer wall members, respectively, to maintain the position of the second elongated member in any of the first and second positions with respect to the first elongated member;

wherein one of the first end of the second elongated member and the second end of the first elongated member is mounted to the undersurface of the top member.

23. The assembly of claim 22 wherein the first end of the second elongated member is mounted to the undersurface of the top member.

24. The assembly of claim 22 wherein the first and second outer members form a substantially right angle, the first and second inner members form a substantially right angle and wherein the first and second lateral members form a substantially right angle.

25. The assembly of claim 22 wherein the external end of the fastener is accessible within the space between the first and second inner wall members.

26. The assembly of claim 25 further including a cover member mounted between the first and second inner wall members that extends substantially along the length of the first elongated member.

* * * * *

UNITED STATES PATENT AND TRADEMARK OFFICE

CERTIFICATE OF CORRECTION

PATENT NO. : 7,866,268 B2
APPLICATION NO. : 11/714454
DATED : January 11, 2011
INVENTOR(S) : Duane F. Nagel et al.

It is certified that error appears in the above-identified patent and that said Letters Patent is hereby corrected as shown below:

Claim 23, Column 24, line 2, "receivable telescopically" should be --telescopically receivable--.

Signed and Sealed this
Eighth Day of March, 2011

David J. Kappos

David J. Kappos
*Director of the United States Patent and Trademark Office*